US012662880B2

(12) United States Patent
Keskiniva et al.

(10) Patent No.: US 12,662,880 B2
(45) Date of Patent: Jun. 23, 2026

(54) HYDRAULIC DOWN-THE-HOLE HAMMER AND SUBSEA PILE

(71) Applicant: Mincon International Limited, Shannon (IE)

(72) Inventors: Markku Keskiniva, Ylinin (FI); Joseph Purcell, Ennis (IE); Simon Duck, Monroe, NC (US)

(73) Assignee: MINCON INTERNATIONAL LIMITED, Shannon (IE)

( * ) Notice: Subject to any disclaimer, the term of this patent is extended or adjusted under 35 U.S.C. 154(b) by 249 days.

(21) Appl. No.: 18/288,494

(22) PCT Filed: Apr. 28, 2022

(86) PCT No.: PCT/EP2022/061429
§ 371 (c)(1),
(2) Date: Oct. 26, 2023

(87) PCT Pub. No.: WO2022/229363
PCT Pub. Date: Nov. 3, 2022

(65) Prior Publication Data

US 2025/0333921 A1 Oct. 30, 2025

(30) Foreign Application Priority Data

Apr. 29, 2021 (IE) ..... 2021/0091
Apr. 30, 2021 (IE) ..... 2021/0095

(51) Int. Cl.

| | |
|---|---|
| ***E02D 27/52*** | (2006.01) |
| ***E02D 5/34*** | (2006.01) |
| ***E02D 7/28*** | (2006.01) |
| ***E21B 4/14*** | (2006.01) |

(52) U.S. Cl.
CPC ..... *E21B 4/14* (2013.01); *E02D 5/34* (2013.01); *E02D 7/28* (2013.01); *E02D 27/525* (2013.01)

(58) Field of Classification Search
CPC ..... E02D 27/525; E02D 5/34; E21B 4/14
See application file for complete search history.

(56) References Cited

U.S. PATENT DOCUMENTS 3,512,366 A * 5/1970 Turzillo ..... E02D 5/30 405/242
4,134,461 A * 1/1979 Blomsma ..... E21B 21/065 175/9
4,158,518 A * 6/1979 Rusche ..... E02D 15/04 405/242

(Continued)

FOREIGN PATENT DOCUMENTS

EP 0 733 152 A1 9/1996
EP 0 733 152 B1 3/2003

(Continued)

OTHER PUBLICATIONS

International Search Report and Written Opinion from corresponding International Patent Application No. PCT/EP2022/061429, dated Oct. 20, 2022.

*Primary Examiner* — Benjamin F Fiorello
(74) *Attorney, Agent, or Firm* — RENNER, OTTO, BOISSELLE & SKLAR, LLP

(57) ABSTRACT

The invention relates to a method and system for installing a load-bearing element in a seabed, a method and system for installing a subsea anchor on a seabed, a subsea pile and a subsea anchor.

21 Claims, 25 Drawing Sheets

(56) References Cited

U.S. PATENT DOCUMENTS

| | | | | |
|---|---|---|---|---|
| 4,509,606 | A | 4/1985 | Willis | |
| 5,154,244 | A * | 10/1992 | Elsby | E21B 4/14 175/414 |
| 5,423,636 | A * | 6/1995 | Mo | E02D 5/36 405/269 |
| 6,109,836 | A | 8/2000 | Gritti | |
| 8,043,028 | B2 * | 10/2011 | Wissmann | E02D 15/04 405/245 |
| 8,240,957 | B1 * | 8/2012 | Watson, III | E02D 5/54 405/252.1 |
| 8,517,639 | B2 * | 8/2013 | Gibberd | E02D 5/40 405/227 |
| 9,605,400 | B2 * | 3/2017 | Fraenkel | E02D 27/52 |
| 2003/0221870 | A1 * | 12/2003 | Johnson, Jr. | E21B 7/201 175/203 |
| 2004/0104049 | A1 * | 6/2004 | Federighi | E02D 5/36 175/57 |
| 2005/0139353 | A1 * | 6/2005 | Johnson | E21B 7/24 166/165 |
| 2007/0012484 | A1 * | 1/2007 | Mocivnik | E02D 5/76 175/320 |
| 2010/0119309 | A1 * | 5/2010 | Gibberd | E02D 7/10 405/228 |

FOREIGN PATENT DOCUMENTS

| | | | |
|---|---|---|---|
| GB | 2 364 728 | A | 2/2002 |
| WO | WO-95/16848 | A1 | 6/1995 |

* cited by examiner

HYDRAULIC DOWN-THE-HOLE HAMMER AND SUBSEA PILE

FIELD OF THE INVENTION

The present invention relates to fluid-operated hydraulic down-the-hole hammers, and in particular, to a disposable or single-use hydraulic down-the-hole hammer. The present invention also relates to a subsea pile, and to methods and systems for installing a load-bearing element and a subsea anchor in a seabed.

BACKGROUND TO THE INVENTION

Hydraulically powered down-the-hole hammers generally include three principal components—an impact piston to impart percussion energy to a drill bit or tool located at a forward end of the hammer; a shuttle or control valve to control the flow of hydraulic fluid in the hammer, to apply pressure to faces of the impact piston, thereby creating cyclical forces that cause reciprocal motion of the piston; and one or more accumulators to take in, store and deliver back pressurised hydraulic fluid to accommodate the varying instantaneous flow requirements created by the reciprocation of the piston.

A conventional hydraulic down-the-hole hammer 100 is shown in FIG. 1. In such conventional hammers, the piston 101 is typically solid and reciprocates within an outer cylinder to impact a bit 109 at a forward end of the hammer. The piston drive chambers 102, 103 are arranged between the piston and an outer cylinder 104, and the control valve 105 and accumulators 106 are positioned at a rear end 107 of the piston. Working fluid is provided to the hammer via pressure line P and returned via return line T. A separate flow of flushing fluid 108 is provided to flush cuttings from the hole. Because of the position of the control valve, the distance $d_{valve}$ between the control valve and the drive chambers is relatively large. The accumulators 106 are typically upstream of the valve 105 and so the distance $d_{accu}$ between the accumulators and the drive chambers is even greater. The long flow channels between the piston and the valve and accumulators can generate pressure waves that can be harmful to the hammer components. The long flow channels also result in pressure losses. The accumulators do not operate efficiently, since the communication delay between the piston and the accumulators is substantial, due to the distance between them.

In a typical water-powered hydraulic hammer, the set-up is similar to that outlined above and shown in FIG. 1. However, in the water-powered hammer 200 shown in FIG. 2, there is no return line T. Instead, the drive fluid is used for flushing flow 208. Furthermore, the piston 201 is fully submerged in water and only a small portion of the cross-sectional area of the piston is used to drive the piston. The rest of the cross-sectional area is idling, as it is exposed to water at ambient pressure. This means that the non-driving area of the piston needs to displace a large amount of water during operation of the hammer. This is achieved by having a central bore 210 through the piston so that the forward 211 and rear 207 ends of the piston are in fluid communication with one another. The bore must be sufficiently large to avoid a significant pressure loss, which would negatively affect hammer performance. Pressure losses can also be reduced by minimising the size of the non-driving areas of the piston. Increasing the size of the central bore and decreasing the size of the non-driving areas of the piston results in a piston with a very small cross-sectional area, which tends to be too lightweight for effective drilling. This is addressed by increasing the length of the piston in order to provide sufficient weight. However, this in turn leads to a hammer that is impractical due to its length, an issue which is exacerbated by the position of the valve to the rear of the piston. Existing water hammers are also complex in design and therefore expensive to produce.

It would be desirable to provide a hydraulic down-the-hole hammer that addresses some of the disadvantages associated with existing arrangements.

Subsea piles may be used to anchor structures used to moor offshore structures such as wind turbines to the seabed. The upper layers of the seabed are often composed of soil or silt and may be weak or unstable. A pile is a load-bearing element that extends through these upper layers to lower, more stable layers of compacted soil and rock, thereby transferring the load from the anchored structure to these lower layers of the seabed.

Existing terrestrial pile installation involves drilling a hole using a hammer, with a casing being pulled down the hole by the hammer as the hole is drilled. Once the hole has reached a target depth, the hammer is removed from the hole, leaving the casing in place. A reinforcing steel bar is dropped down the centre of the casing and the hole is then filled with grout. The casing may be removed before the grout is cured, in which case the grout bonds the reinforcing steel bar to the material of the surrounding terrain.

However, subsea pile installation presents a number of difficulties which mean that such terrestrial installation methods are unsuitable. One common method of fixing subsea anchors to the seabed is using driven piles, where the pile is driven into the seabed by a large underwater hydraulic hammer. Alternatively, a suction pile installation method may be used where a hollow pile is dropped onto the seabed, creating a seal between the bottom of pile and the seabed. Water is then pumped out from the hollow centre of the pile to create a suction effect which pulls the pile further down into the seabed.

Subsea piles as described above may be used to fix a subsea anchor to the seabed. Such subsea anchors may comprise a frame or template which is fixed to the seabed using one or more piles. A wind turbine or other offshore structure can then be moored or otherwise fixed to the subsea anchor.

A method for installation of such subsea pile anchors is disclosed in United States Patent Application Publication No. US 2015/0233079. The method involves placing a frame on the seabed, arranging a seabed drill on the frame and using the drill to drive a pile anchor into the seabed. Grout is then pumped around the pile anchor to bond the pile to the ground. This process may be repeated for several pile anchors to fix the frame to the seabed. A mooring connection on the frame may then be used to moor an offshore structure to the anchor.

There are a number of disadvantages associated with these installation methods. Both driven piles and suction piles are relatively slow to install. For driven piles, the underwater hammer is large, complex and expensive and requires a large support vessel. The suction method is only suitable where the seabed is soft and sandy, and cannot be used where there are boulders or obstacles.

It would be desirable to provide a method and system for installing a pile or load-bearing element in a seabed, for example, for anchoring a structure such as a wind turbine, which overcomes some of the disadvantages associated with existing methods.

SUMMARY OF THE INVENTION

According to an aspect of the present invention, there is provided a hydraulic down-the-hole hammer comprising:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore; and a control valve to control reciprocation of the piston, wherein the control valve is arranged within the central bore of the piston.

The term "forward" is used herein to indicate an end of the hammer towards the percussion bit, that is, the drilling end of the hammer. The term "rear" is used herein to indicate an end of the hammer, away from the percussion bit, that is, an end of the hammer that is uppermost during drilling.

There are several advantages associated with this arrangement. Because the valve is arranged within the piston, the distance travelled by the fluid between the valve and the drive chambers is minimised, thereby eliminating harmful pressure waves. Pressure losses are also very low. Because the drive chambers are inside the piston, rather than between the piston and an outer sleeve, the sealing diameters are reduced as compared with a conventional hammer. This reduces leakage which is particularly important for water-powered hammers due to the low viscosity of the working fluid. The hammer is also less expensive to produce due to its simple design.

Preferably, the control valve is arranged internally of the shaft.

In preferred embodiments, the piston has a monolithic or unitary construction, that is, it is formed as a single piece. Because the annular shoulder on the piston dividing the forward and rear chambers is provided on the inside of the piston bore, it is possible to manufacture and assemble the piston into the hammer in a single piece.

Ideally, the piston is arranged to impact an annular shoulder at a rear end of the percussion or drill bit. The annular shoulder may be provided on the skirt of the drill bit. An advantage of this arrangement is that the impact force is transmitted directly to the gauge of the drill bit at the point where the highest impact energy is required for drilling.

In certain embodiments, the hammer may comprise at least one accumulator arranged at a rear end of the piston. Because the valve is arranged within the piston, the accumulator or accumulators may be positioned much closer to the piston than in conventional arrangements, thereby reducing $d_{accu}$ and consequently improving efficiency.

In an embodiment of the hammer, the working fluid is water. In this embodiment, the rear chamber may be connected to a pressure fluid channel and the control valve may be arranged to connect the forward chamber to the rear chamber while the piston is moving in a rearward direction and arranged to connect the forward chamber to a flushing fluid channel through the shaft and the percussion bit when the piston is moving in a forward direction. Because the rear chamber is connected to a pressure fluid channel throughout the piston cycle, there is a constant pressure in the rear chamber and an alternating pressure in the forward chamber.

In some embodiments, the hammer may further comprise an outer wear sleeve, such that the piston is housed within the wear sleeve. As in conventional hammers, the outer wear sleeve protects the piston from wear during drilling. The percussion bit may be arranged at a forward end of the wear sleeve. In an embodiment, the hammer is a closed-loop hammer and a flushing fluid channel may be provided between the piston and the wear sleeve and through the percussion bit. This means that the full outer surface of the piston may be exposed to flushing flow, thereby providing very efficient cooling for the piston.

In another embodiment, a working fluid of the hammer is water and a flow annulus is provided between the piston and the outer wear sleeve to provide fluid communication between forward and rear ends of the piston. A flushing fluid channel is provided through the shaft and the percussion bit. Because the drive chambers of the hammer are provided inside the piston bore, the flow communication between forward and rear ends of the piston may be provided by the flow annulus on the outside of the piston, rather than via the piston bore as in conventional water hammers. Such a flow annulus has inherently large flow area even with a small radial clearance between the piston and wear sleeve. This means that the cross-sectional area of the piston may be increased as compared with conventional water hammers, thereby allowing sufficient piston weight to be achieved with a short piston. The placement of the valve within the piston further decreases the length of the hammer.

According to an aspect of the present invention, the piston is the outermost component of the hammer. That is, the hammer does not include an outer wear sleeve to house the piston. By omitting the conventional outer wear sleeve from the hammer, the cost of the hammer is reduced, allowing it to be used as a single-use, sacrificial or disposable hammer. Because the piston is the outermost component of the hammer, it will be exposed to wear from cuttings. However, since the hammer is disposable, the piston need only last long enough to drill a single hole. For example, the hammer may be left in the hole when the hole has been drilled.

A flushing port may be provided in the shaft extending from the central bore of the shaft to an outer surface of the shaft at a forward end of the piston. This allows a portion of the flushing water to exit between strike faces of the piston and the bit, thereby flushing cuttings away from the strike faces to avoid damage thereto.

In various embodiments of the hammer according to the present invention, the shaft may comprise a coupling element at forward end thereof, wherein the coupling element couples the percussion bit to the hammer and transmits rotational drive thereto.

Engagement means may be formed on the coupling element engageable with complementary engagement means formed internally of the bit whereby rotational drive from the shaft may be transmitted to the bit. In an embodiment, the coupling element is formed with a central bore and the flushing port is provided in the coupling element, extending from the central bore thereof to an outer surface of the coupling element at a forward end of the piston. The engagement means may comprise a plurality of axially extending splines formed externally of the coupling element and the complementary engagement means may comprise a corresponding plurality of axially extending splines formed internally of the bit. In other embodiments, the engagement means may comprise a portion of the coupling element with a hexagonal or square cross-section, and the complementary engagement means may comprise an internal portion of the bit formed with a correspondingly-shaped inner wall.

The hammer may further comprise bit retaining means on the coupling element adapted for engagement with complementary retaining means on the bit to retain the bit in the hammer. The bit retaining means may comprise a first screw thread formed externally of the coupling element at a forward end thereof, and the complementary engagement means may comprise a second screw thread formed internally of the bit. The hammer bit may be assembled to the hammer by threading the bit onto the coupling element such that the first screw thread is located forward of the second screw thread. This arrangement retains the bit in the hammer and allows limited longitudinal movement of the bit.

In another embodiment, the bit retaining means comprises a bit retaining ring, comprising a plurality of part-annular sectors, and the complementary engagement means comprises a shoulder formed internally of the bit. In this embodiment, the coupling element may comprise a chuck.

According to an aspect of the present invention, there is provided a method for installing a load-bearing element, such as a subsea pile, in a seabed, comprising:

drilling a hole of a desired depth in the seabed using a hydraulic down-the-hole hammer, wherein the hammer is operated by supplying working fluid to the hammer;

while the hammer is disposed or located in the hole, ceasing supply of working fluid to the hammer;

supplying grout to the hammer to at least partially fill the hammer and the hole in which the hammer is disposed or located with grout; and allowing the grout to cure such that the hammer and the grout form a load-bearing element in the seabed.

Filling the hammer and/or the hole may comprise partially filling the hammer and/or the hole with grout such that the hammer is bonded to the seabed material in which the hole is formed. In certain embodiments, the hammer and/or the hole may be entirely filled with grout. Grout may be supplied to the hammer until the grout is substantially level with a surface of the seabed.

This method has a number of advantages over existing methods for installation of subsea piles. In particular, the method disclosed herein allows installation to be carried out more quickly. Furthermore, the use of a down-the-hole hammer allows the pile to be installed in a variety of seabed types, even in terrain with little sand or soil and where rock or boulders are present. However, because the hammer itself forms part of the load-bearing element, it is required to be single-use only and can therefore be made more cheaply than a typical hammer used to drive piles into the seabed.

The hammer may be a hammer according to any of the embodiments described above. The hammer used to perform the method may be a disposable, single-use or sacrificial hammer in which the working fluid is water, such as the hammer described above. In one embodiment, the disposable or sacrificial hammer does not include an outer wear sleeve. Rather, the piston is the outermost component of the hammer.

In an embodiment, a drill rig is connected to the hammer and the hammer and drill rig are lowered to the seabed prior to drilling the hole. The drill rig may be operated to provide rotation and feed force to the hammer during drilling of the hole. After the hole has been filled with grout, the drill rig may be disconnected from the hammer and brought to a surface of the sea. In some embodiments, a drill pipe may be provided between the drill rig and the hammer, and the drill pipe is grouted into the drilled hole with the hammer so that the hammer, drill pipe and grout together form a load-bearing element or subsea pile.

According to another aspect of the invention, there is provided a system for installing a load-bearing element in a seabed, comprising:

a hydraulic down-the-hole hammer;

a supply of working fluid, wherein the hammer is connectable to the supply of working fluid for drilling a hole of a desired depth in the seabed;

a supply of grout, wherein the hammer is connectable to the supply of grout while disposed or located in the hole to allow the hammer and the hole to be filled with grout.

The system may comprise a drill rig configured to provide rotation and feed force to the hammer during drilling of the hole, wherein the drill rig is connected to the hammer and lowered to the seabed with the hammer prior to drilling the hole.

The system may further comprise at least one drill rod or pipe connected between the drill rig and the hammer. The drill pipe may be sacrificial, and may be grouted into the hole with the hammer so that the hammer, drill pipe and grout together form a load-bearing element or subsea pile.

The supply of working fluid and the supply of grout may be provided at a sea surface level above the seabed and the system may further comprise an umbilical, wherein the hammer is connectable to the supply of working fluid and the supply of grout through the umbilical. In an embodiment, a working fluid pump is configured to provide the supply of working fluid to the hammer and a grout pump is configured to provide the supply of grout to the hammer. The pumps may be provided on a vessel or rig disposed at or near the sea surface. The umbilical may comprise one or more cables or hoses arranged to connect the hammer and or the drill rig with surface utilities, such as the working fluid pump and the grout pump. The umbilical may comprise a single channel selectively connectable to the supply of working fluid and the supply of grout. Alternatively, the umbilical may comprise a first channel connectable to the supply of working fluid to supply working fluid to the hammer and a second channel connectable to the supply of grout to supply grout to the hammer.

The hammer may have a central bore through which grout is supplied to the hammer and to the hole. The drill pipe may also have a central bore through which the working fluid and grout, respectively, are supplied to the hammer. The working fluid of the hammer may be water. A piston of the hammer may be the outermost component of the hammer. The hammer may be a hammer according to any of the embodiments described above. Preferably, the hammer is a disposable or sacrificial water hammer as described above.

In an embodiment, the percussion bit has a larger diameter than the piston, such that a diameter of the drilled hole is greater than a diameter of the piston and there exists an annular cavity between the piston and a wall of the drilled hole.

In an embodiment, a diameter of the percussion bit may be less than or equal to 300 mm. The resulting load-bearing element may be referred to as a micro-pile, which may be preferred over larger piles as they are smaller, lighter, cheaper, easier to install, and produce less noise and vibration.

According to an aspect of the present invention, there is provided a subsea pile, comprising:

a hydraulic down-the-hole hammer, disposed or located in a hole in the seabed; and cured grout arranged within the hammer and between the hammer and a wall of the hole such that the hammer is bonded to the material of the seabed by the grout.

The hammer may be a hammer according to any of the embodiments described above. For example, the hammer of the subsea pile may be a disposable, single-use or sacrificial hammer in which the working fluid is water. In one embodiment, the disposable or sacrificial hammer does not include an outer wear sleeve. Rather, the piston may be the outermost component of the hammer.

The subsea pile may further comprise at least one drill rod or pipe connected to the hammer and disposed in the hole in the seabed, wherein the cured grout is further arranged within the drill rod or pipe and between the drill rod or pipe and the wall of the hole such that the drill rode or pipe is also bonded to the material of the seabed by the grout.

In an embodiment, the subsea pile may be a subsea micro-pile having a diameter less than or equal to 300 mm.

The subsea pile may comprise a column of grout into which a hydraulic down-the-hole hammer, and optionally, a drill pipe, is embedded.

According to an aspect of the present invention, there is provided a method for installing a subsea anchor on a seabed, comprising:

connecting a drill rig and one or more down-the-hole hydraulic hammers to an anchor frame, wherein the drill rig is configured to provide a rotation and feed force to each of the one or more hammers;

lowering the anchor frame to the seabed;

supplying working fluid to the or each hammer, such that the or each hammer drills a hole of a desired depth in the seabed;

while the or each hammer is located in its respective hole, ceasing supply of working fluid to the or each hammer and supplying grout to the or each hammer to at least partially fill the hammer and the hole in which the hammer is located with grout;

allowing the grout to cure such that the or each hammer is bonded to the material of the seabed by grout; and disconnecting the drill rig from the anchor frame.

The or each hammer may be a hammer according to any of the embodiments described above. For example, the or each hammer used to perform the method may be a disposable, single-use or sacrificial hammer in which the working fluid is water. In one embodiment, the or each disposable or sacrificial hammer does not include an outer wear sleeve. Rather, the piston may be the outermost component of the hammer.

This method has a number of advantages over existing methods for installation of subsea anchors. In particular, because the piles that fix the anchor to the seabed are formed using disposable or sacrificial down-the-hole hammers that are grouted into the holes, there is no requirement for a separate hydraulic hammer to perform the drill. These single-use hammers can be made more cheaply than a typical hammer used to drive piles into the seabed.

Preferably, the drill rig provides a separate rotation and feed force to the or each hammer. This allows each hole in the seabed to be drilled simultaneously.

A mooring line may be coupled to the anchor frame to moor an offshore structure such as a wind turbine to the seabed.

According to an aspect of the present invention, there is provided a system for installing a subsea anchor on a seabed, comprising:

an anchor frame;

a drill rig and one or more down-the-hole hydraulic hammers connectable to the anchor frame, wherein the drill rig is configured to provide a rotation and feed force to each of the one or more hammers;

a supply of working fluid, wherein the or each hammer is connectable to the supply of working fluid for drilling a hole of a desired depth in the seabed;

a supply of grout, wherein the or each hammer is connectable to the supply of grout while located in its respective hole to allow the hammer and the hole to be at lerast partially filled with grout.

Preferably, the drill rig comprises a separate feed and rotation system for each of the one or more hammers.

The supply of working fluid and the supply of grout may be provided at a sea surface level above the seabed, and the system may further comprise:

an umbilical, wherein the or each hammer is connectable to the supply of working fluid and the supply of grout through the umbilical.

The or each hammer may be a hammer according to any of the embodiments described above. The working fluid of the or each hammer may be water. The or each hammer may be a disposable or sacrificial hammer as described above. A piston of the or each hammer may be the outermost component of the hammer. The percussion bit of the or each hammer may have a larger diameter than the piston, such that a diameter of the or each drilled hole is greater than a diameter of the respective piston and there exists an annular cavity between the or each piston and a wall of the respective drilled hole. The anchor frame may comprise connection means for connection to the one or more hammers. In an embodiment, the connection means may comprise one or more connectors, wherein a connector is provided for connection to the or each hammer. Each connector may comprise a mounting sleeve or boss.

The system may further comprise at least one drill rod or pipe connected between the drill rig and the or each hammer. The drill pipe may also be sacrificial, and may be grouted into the or each hole with the corresponding hammer so that each hammer, drill pipe and grout together form a load-bearing element or subsea pile connected to the anchor frame to anchor it to the seabed.

According to an aspect of the present invention, there is provided a subsea anchor, comprising:

an anchor frame, disposed on the seabed; and one or more hydraulic down-the-hole hammers connected to the anchor frame, the or each hammer located in a respective hole in the seabed; and cured grout arranged within the or each hammer and between the hammer and a wall of the respective hole such that the or each hammer is bonded to the material of the seabed by the grout.

The or each hammer may be a hammer according to any of the embodiments described above. For example, the or each hammer of the subsea anchor may be a disposable, single-use or sacrificial hammer in which the working fluid is water. In one embodiment, the or each disposable or sacrificial hammer does not include an outer wear sleeve. Rather, the piston may be the outermost component of the hammer.

The subsea anchor may further comprise at least one drill rod or pipe connected to the or each hammer and disposed in the corresponding hole in the seabed, wherein the cured grout is further arranged within the or each drill rod or pipe and between the or each drill rod or pipe and the wall of the corresponding hole such that the drill rod or pipe is also bonded to the material of the seabed by the grout.

DETAILED DESCRIPTION OF THE DRAWINGS

Figure 3:
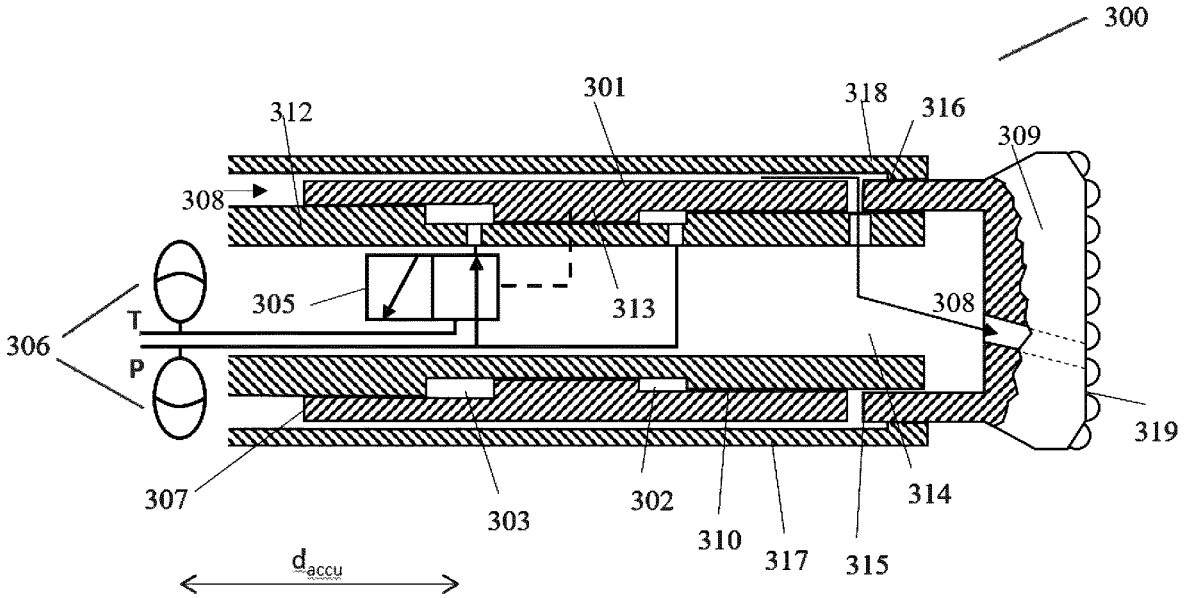
FIG. 3 is a schematic representation of a hydraulic down-the-hole hammer according to an embodiment of the present invention.

A hydraulic down-the-hole hammer 300 according to an embodiment of the present invention is illustrated in FIG. 3. The hammer comprises an elongate shaft 312 formed with a central bore 314. A piston 301 also has a central bore 310 therethrough. The shaft is received within the piston bore such that the piston is slidably mounted for reciprocal movement on the shaft 312 and arranged to impact an annular shoulder 315 at a rear end 316 of a percussion bit 309. The piston 301 is housed within an outer wear sleeve 317, and the percussion bit 309 is arranged at a forward end 318 of the wear sleeve.

Forward 302 and rear 303 drive chambers for the piston are disposed between the piston 301 and the shaft 312. An annular shoulder 313 on the piston formed internally of the piston bore 310 separates the forward chamber 302 from the rear chamber 303. An internal diameter of the piston 301 to the rear of the shoulder 313 is greater than the internal diameter of the piston forward of the shoulder, such that the rear chamber has a larger driving area than the forward chamber. The hammer also comprises a control valve 305 arranged within the central bore 314 of the shaft to control reciprocation of the piston. In other embodiments, the valve 305 may be arranged within the central bore 310 of the piston, between the piston and the shaft.

The hammer 300 is a closed-loop hammer in which working fluid is provided to the hammer via pressure line P and returned via return line T. A flushing fluid channel 308 is provided between the piston 301 and the wear sleeve 317 and through the percussion bit 309, such that the flushing fluid exits the channel at the bit face 319.

The hammer 300 further comprises pressure and return fluid accumulators 306 arranged at a rear end 307 of the piston. The accumulators are arranged a distance $d_{accu}$ from the rear drive chamber 303 of the piston.

Figure 4:
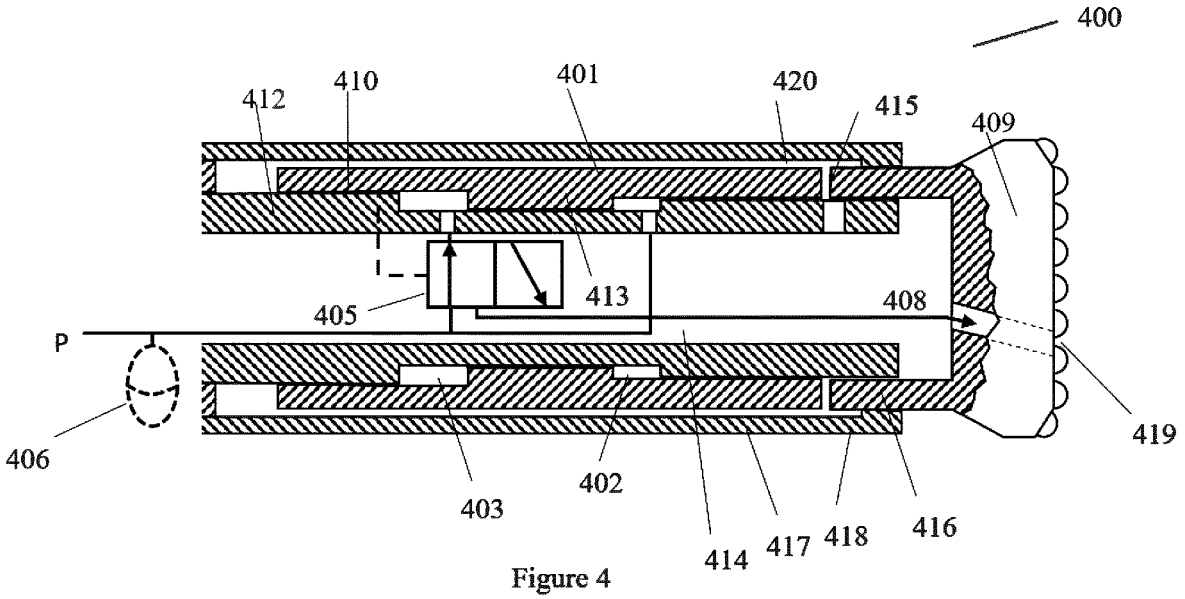
FIG. 4 is a schematic representation of a water hammer according to an embodiment of the present invention.

A hydraulic down-the-hole hammer 400 according to another embodiment of the invention is illustrated in FIG. 4. As in the embodiment of FIG. 3, the hammer comprises an elongate shaft 412 formed with a central bore 414. A piston 401 also has a central bore 410 therethrough. The shaft is received within the piston bore such that the piston is slidably mounted for reciprocal movement on the shaft 412 and arranged to impact an annular shoulder 415 at a rear end 416 of a percussion bit 409. The piston 401 is housed within an outer wear sleeve 417, and the percussion bit 409 is arranged at a forward end 418 of the wear sleeve.

Forward 402 and rear 403 drive chambers for the piston are disposed between the piston 401 and the shaft 412. An annular shoulder 413 on the piston formed internally of the piston bore 410 separates the forward chamber 402 from the rear chamber 403. An internal diameter of the piston 401 to the rear of the shoulder 413 is greater than the internal diameter of the piston forward of the shoulder, such that the rear chamber has a larger driving area than the forward chamber. The hammer also comprises a control valve 405 arranged within the central bore 414 of the shaft to control reciprocation of the piston.

Figure 1:
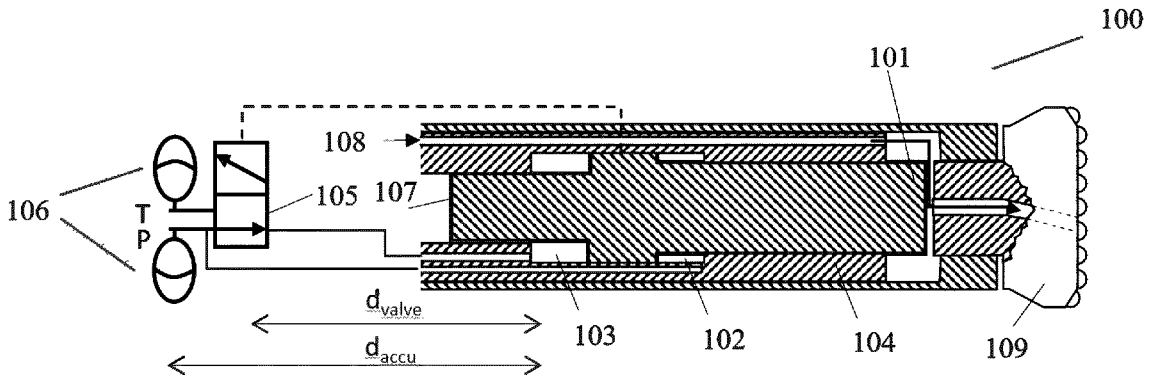
FIG. 1 is a schematic representation of a conventional hydraulic down-the-hole hammer.
Figure 2:
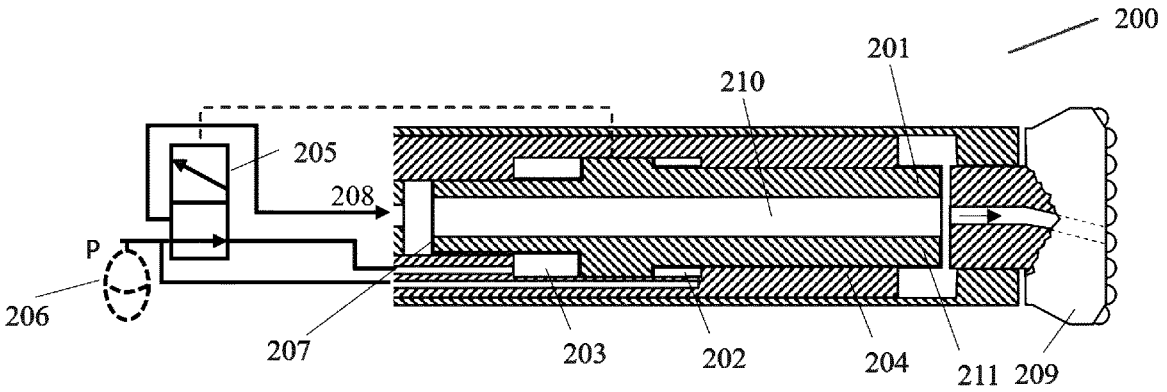
FIG. 2 is a schematic representation of a conventional down-the-hole water hammer.

The hammer 400 shown in FIG. 4 is an open-loop hammer in which a working fluid such as water is provided to the hammer via pressure line P. However, unlike the hammer of FIG. 3, the hammer 400 does not have a return line. Instead, the drive fluid is used for flushing flow 408 through the central bore 414 of the shaft and the percussion bit 409 to exit at the bit face 419. Unlike prior art hammers, the outer surface of the piston is not a sealing surface and so a flow annulus 420 to allow fluid communication between the forward and rear ends of the piston is provided between the piston and the wear sleeve, rather than via the piston bore as in the conventional water hammer shown in FIG. 2. This allows the cross-sectional area of the piston to be increased as compared with such conventional water hammers, thereby allowing sufficient piston weight to be achieved with a short piston. The placement of the valve 405 within the piston allows the distance $d_{accu}$ to be reduced and further decreases the length of the hammer.

Figure 5:
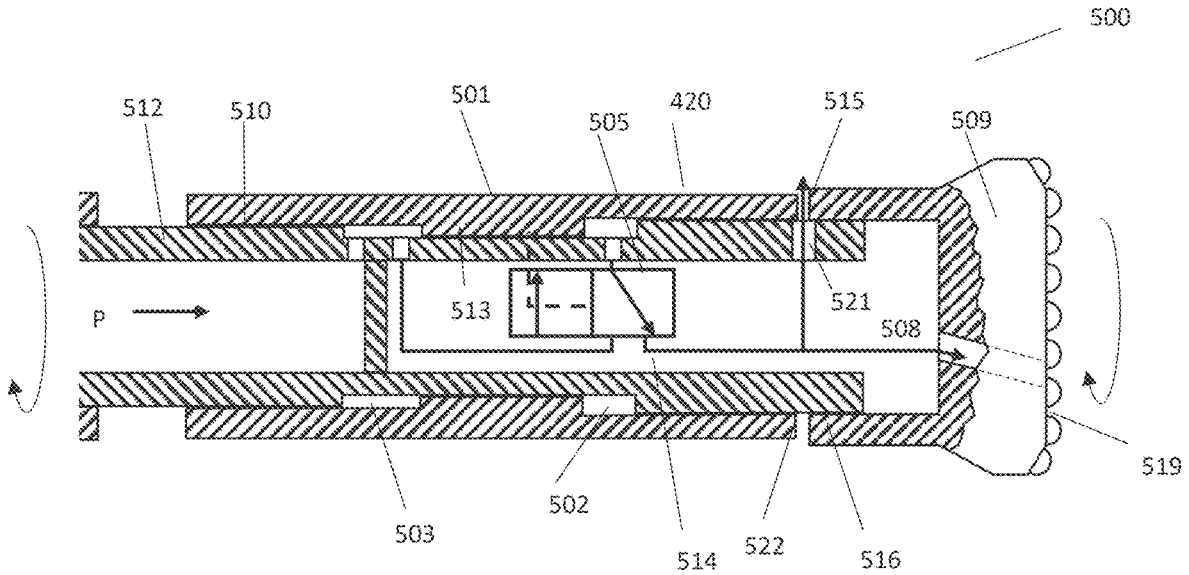
FIG. 5 is a schematic representation of a disposable water hammer according to an embodiment of the present invention.

A low-cost disposable or single-use hydraulic down-the-hole hammer 500 according to an embodiment of the invention is illustrated in FIG. 5. As in the embodiment of FIG. 4, the hammer comprises an elongate shaft 512 formed with a central bore 514. A piston 501 also has a central bore 510 therethrough. The shaft is received within the piston bore such that the piston is slidably mounted for reciprocal movement on the shaft 512 and arranged to impact an annular shoulder 515 at a rear end 516 of a percussion bit 509. Forward 502 and rear 503 drive chambers for the piston are disposed between the piston 501 and the shaft 512. An annular shoulder 513 on the piston formed internally of the piston bore 510 separates the forward chamber 502 from the rear chamber 503. In this embodiment, an internal diameter of the piston 501 to the rear of the shoulder 513 is smaller than the internal diameter of the piston forward of the shoulder, such that the forward chamber has a larger driving area than the rear chamber. The hammer also comprises a control valve 505 arranged within the central bore 514 of the shaft to control reciprocation of the piston.

Like the hammer of FIG. 4, the hammer 500 shown in FIG. 5 is an open-loop hammer in which a working fluid such as water is provided to the hammer via pressure line P. However, unlike the hammer of FIG. 4, the hammer 500 does not include an outer sleeve, so that the piston 501 is the outermost component of the hammer. This reduces the cost of the hammer so that it can be used as a disposable or sacrificial hammer that is used to drill a single hole only.

In this embodiment, the rear chamber 503 is connected to a pressure fluid channel P so that there is a constant pressure in the rear chamber. The control valve 505 is arranged to connect the forward chamber 502 to the rear chamber 503 while the piston is moving in a rearward direction and to connect the forward chamber 502 to a flushing fluid channel 508 through the central bore of the shaft and the percussion bit when the piston is moving in a forward direction, so that there is an alternating pressure in the forward chamber 502.

Because the hammer 500 does not include an outer wear sleeve or cylinder, the piston itself will be exposed to wear from drill cuttings. However, since the hammer is disposable, the piston need only last long enough to drill a single hole. In addition, radial flushing ports 521 extend from the central bore 514 of the shaft to an outer surface of the shaft, allowing part of the exhaust fluid to exit between a forward end 522 of the piston 501 and the strike face 515 of the bit. This keeps drill cuttings away from the strike faces of the bit and the piston and prevents premature damage to the strike faces.

Figure 6A:
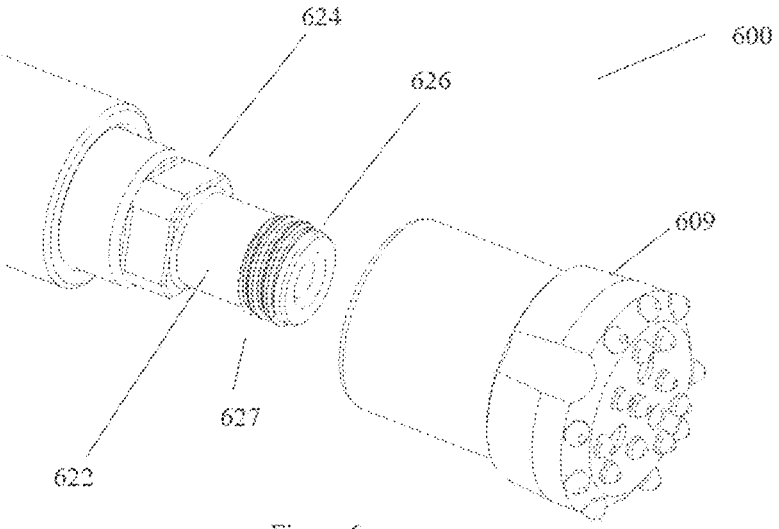
FIG. 6*a* is a perspective view of a coupling element and a bit of a hammer according to the present invention.
Figure 6B:
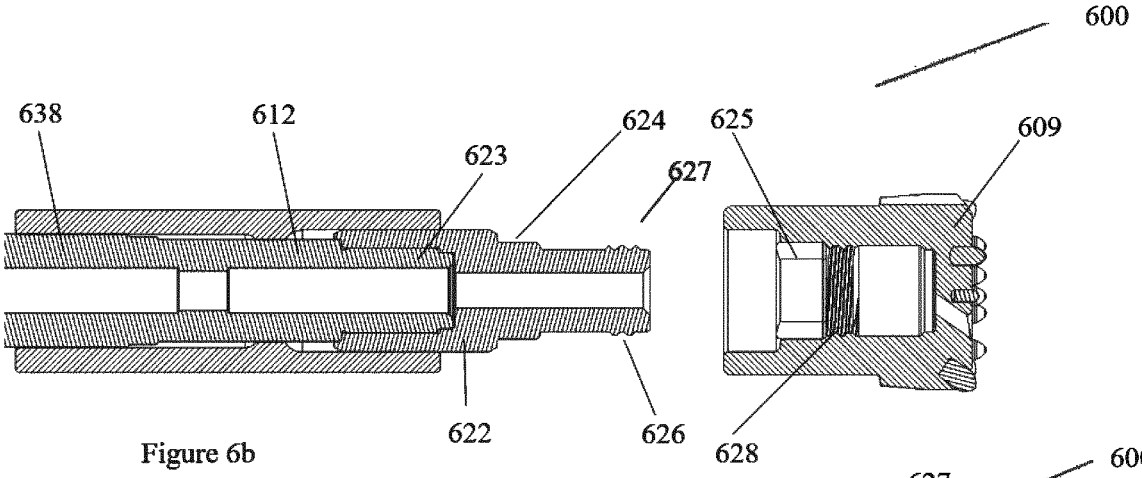
FIG. 6*b* is a cross-sectional view of the coupling element and bit of FIG. 6*a*, in which the coupling element is assembled to a piston and shaft of the hammer.
Figure 6C:
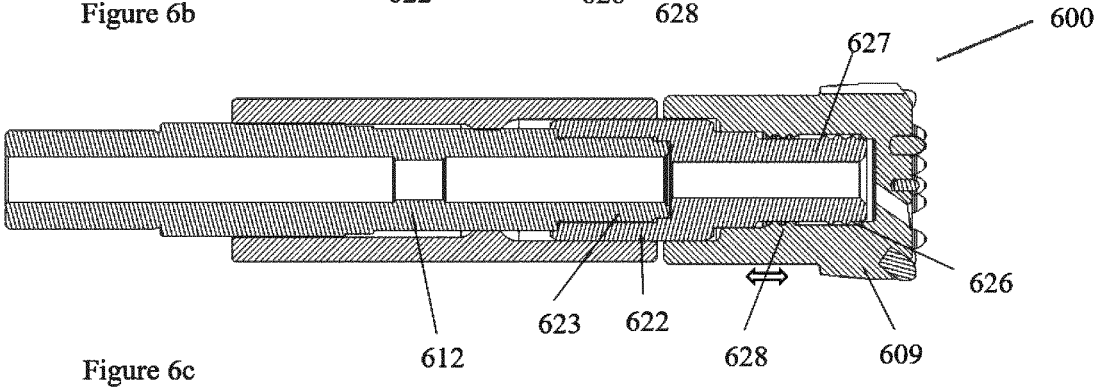
FIG. 6*c* is a cross-sectional view of the assembly of FIG. 6*b*, in which the bit is coupled to the coupling element.

FIGS. 6*a*, 6*b* and 6*c* illustrate a coupling arrangement for coupling a percussion bit to a hammer according to the present invention. Hammer 600 shown in FIGS. 6*a*, 6*b* and 6*c* is similar in several respects to disposable hammer 500 shown in FIG. 5 but the coupling arrangement shown may also be applied to hammers 300, 400 shown in FIGS. 3 and 4, as well as other hammers in accordance with the invention.

The shaft 612 of hammer 600 comprises a coupling element 622 at forward end 623 thereof. As shown in FIGS. 6*b* and 6*c*, an outer diameter of the coupling element is greater than an outer diameter of a main body 638 of the shaft, so that the forward chamber is sealed by the coupling element and the piston. A portion 624 of the coupling element is formed with a square cross-section and a corresponding internal portion 625 of the bit 609 is formed with a square-shaped inner wall, such that, when the bit is assembled to the coupling element of the shaft, the portion 624 of the coupling element is received within the portion 625 of the bit, to allow rotational drive to be transmitted from the shaft to the bit. In other embodiments, the portion 624 of the coupling element may be formed with a hexagonal or octagonal cross-section and the internal portion of the bit may be correspondingly shaped. In further embodiments, axially-extending splines may be provided externally of the coupling element, engageable with corresponding splines provided internally of the bit, for transmission of rotational drive.

The coupling element 622 further comprises bit retaining means engageable with complementary bit retaining means on the bit 609 for longitudinal coupling of the bit to the hammer. In the embodiment shown in FIGS. 6*a*, 6*b* and 6*c*, the bit retaining means comprises a first screw thread 626 formed externally of the coupling element 622 at a forward end 627 thereof. The complementary engagement means comprises a second screw thread 628 formed internally of the bit.

The bit is coupled to the hammer by threading the second screw thread 628 bit through the first screw thread 626 such that the first screw thread is forward of the second screw thread. This couples the bit to the coupling element in a longitudinal direction and retains the bit in the hammer, while allowing limited longitudinal movement of the bit. Next, the bit is rotated to line up the portion 625 of the bit with the square-shaped portion 624 of the coupling element, such that the portion 624 of the coupling element is received within portion 625 of the bit to engage the rotational coupling. The coupling element 622 is coupled to the main body 638 of the shaft by way of a screw-threaded connection.

Figure 7A:
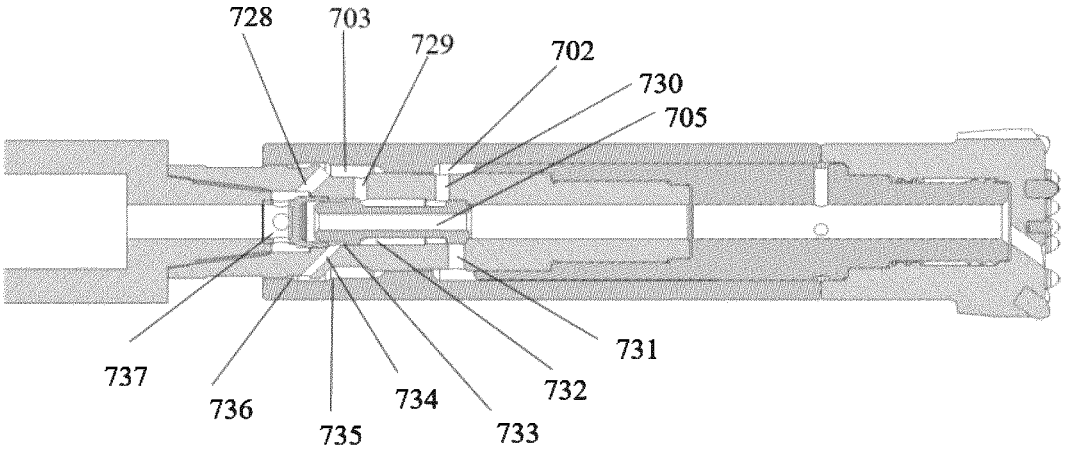
FIG. 7*a* is a cross-sectional view of a disposable water hammer according to an embodiment of the present invention.
Figure 7B:
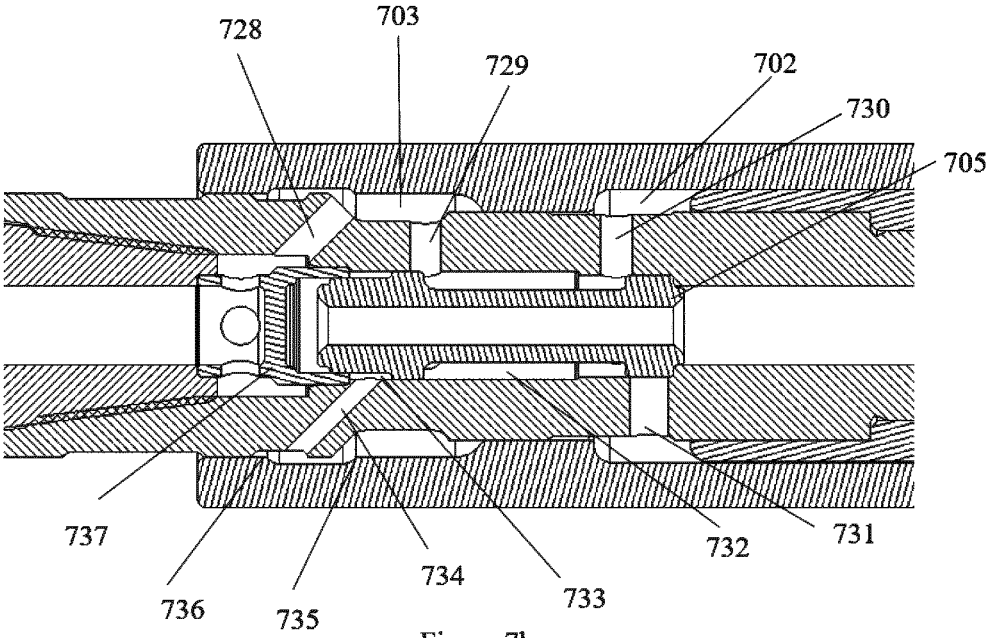
FIG. 7*b* is a detail view of a portion of the hammer of FIG. 7*a;*

A control valve 705 suitable for use in a hammer 700 according to the present invention is illustrated in FIGS. 7*a* and 7*b*. The valve is particularly suitable for a disposable hammer according to the present invention, such as that shown in FIG. 5. The valve 705 comprises a top or rear inlet port 728 and a top or rear outlet port 729. The valve further comprises a bottom or forward inlet port 730 and a bottom or forward outlet port 731. Also shown in FIG. 7*a* are the valve chamber 732, the pilot chamber 733, the pilot port 734, the front control edge 735, rear control edge 736 and the control valve cap 737.

Figure 8A:
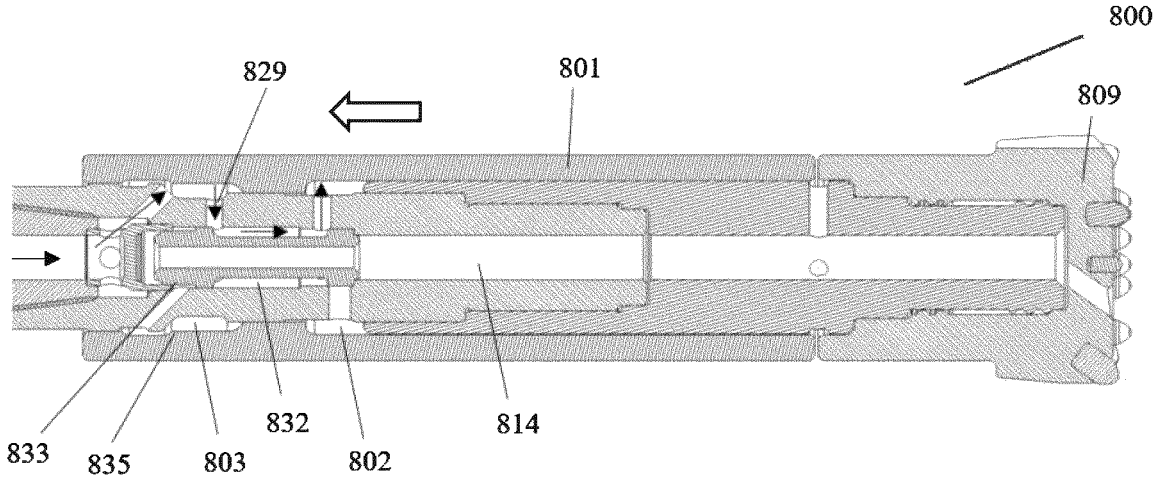
FIGS. 8*a* to 8*d* depict different stages of the hammer cycle of the hammer of FIGS. 7*a* and 7*b;*

An example of the hammer cycle for a disposable hammer including the valve of FIGS. 7*a* and 7*b* is illustrated in FIGS. 8*a* to 8*d*. In FIG. 8*a*, the piston 801 is moving in an upward or rearward direction (to the left as shown in the drawings). The rear chamber 803 is connected to pressure fluid throughout the hammer cycle. The forward chamber 802 is connected to high pressure fluid through the valve chamber 832 and the rear chamber 803, as shown by the arrows. The forward chamber has a bigger pressure area than the rear chamber, due to the increased internal diameter of the piston 801 so that the piston moves in a rearward direction. The valve pilot chamber 833 is pressurised through the front control edge 835 which has connected the pilot chamber to the rear chamber 803. The pilot chamber has a bigger pressure area than the valve chamber. The flow connection between the forward chamber 802 and the shaft bore 814 is closed and the flow connection between the forward chamber and the valve chamber 832 is open. The valve chamber is continuously connected to the rear chamber 803 via the rear outlet port 829.

Figure 8B:
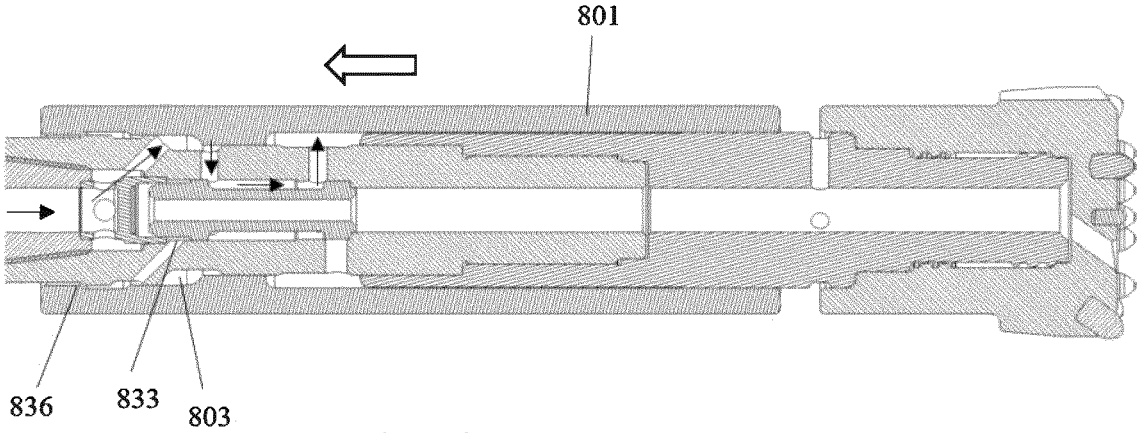

In FIG. 8*b*, the piston 801 has reached a point where a flow connection has been opened from the pilot chamber 833 to the ambient pressure via the rear control edge 836.

The pressure in the pilot chamber will drop and there will be a net hydraulic force causing the valve 805 to switch.

Figure 8C:
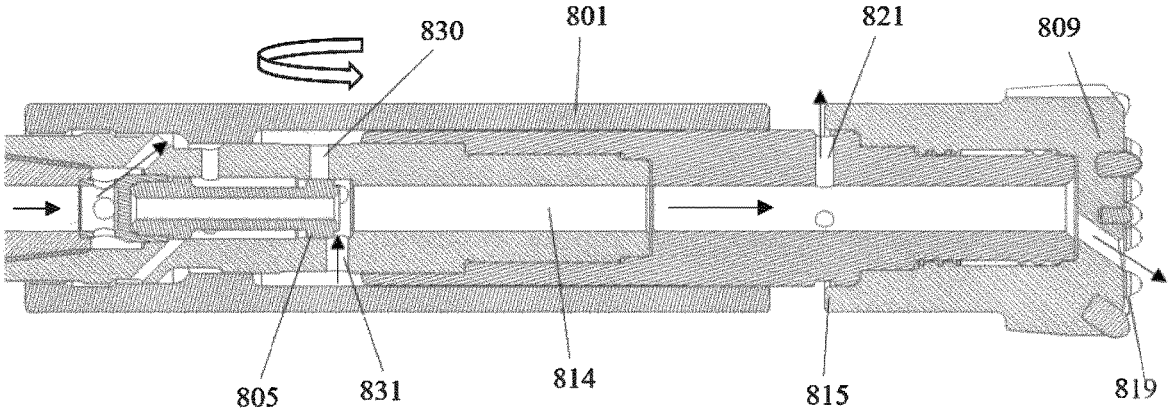

In FIG. 8*c*, the valve 805 has switched. The valve has closed the forward inlet port 830 and opened the forward outlet port 831 so that exhaust water flows into the shaft bore 814, as shown by the arrow. The hydraulic force reverses the direction of the piston 801 and drives it towards the drill bit 809. The main portion of the exhaust water will flow through the shaft bore and the bit to exit at the bit face 819, as shown by the arrows, to flush cuttings from the bit face. A small portion of the exhaust water will flow out through the radial holes or ports 821 located close to the bit strike face 815, as shown by the arrows, to flush cuttings from the strike faces of the bit and the piston.

Figure 8D:
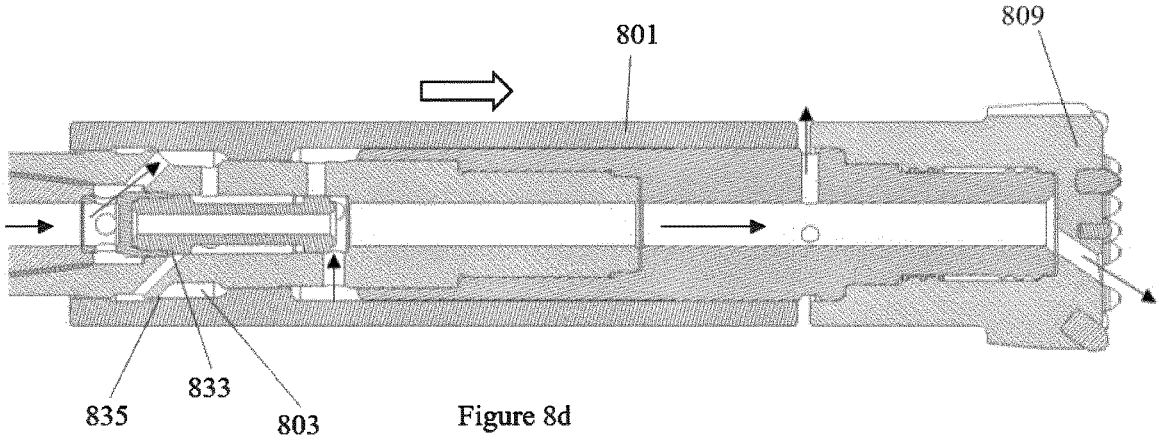

In FIG. 8*d*, the piston 801 is travelling towards the bit 809 (to the right as shown in the drawings). Just before the impact, the piston 801 will connect the pilot chamber 833 to the rear chamber 803 via the front control edge 835. This causes the valve to switch just after the piston has impacted the drill bit. The cycle begins again as shown in FIG. 8*a*.

Figure 18A:
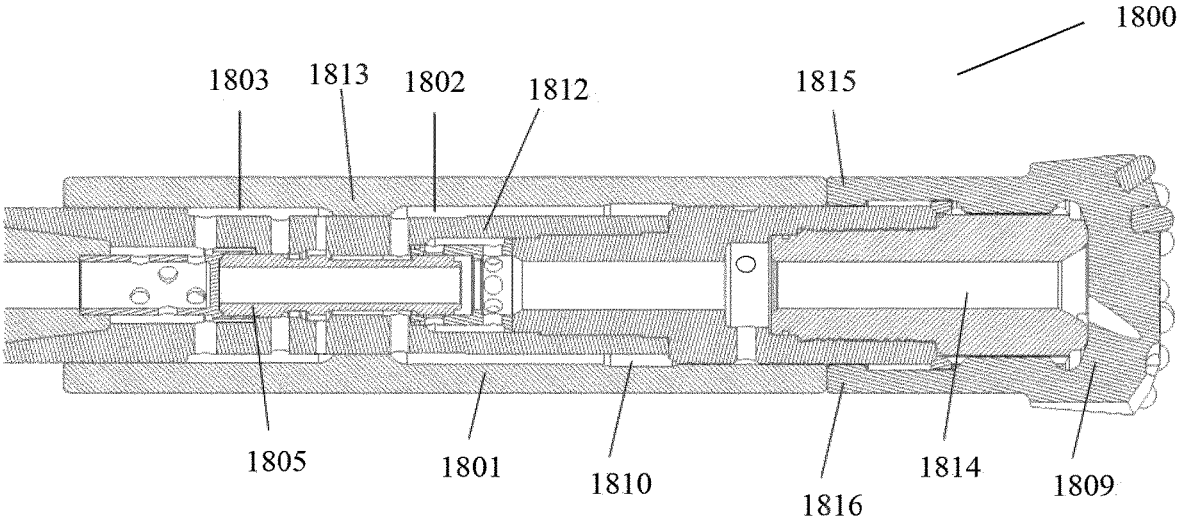
FIG. 18*a* is a cross-sectional view of a disposable water hammer according to an embodiment of the present invention.
Figure 18B:
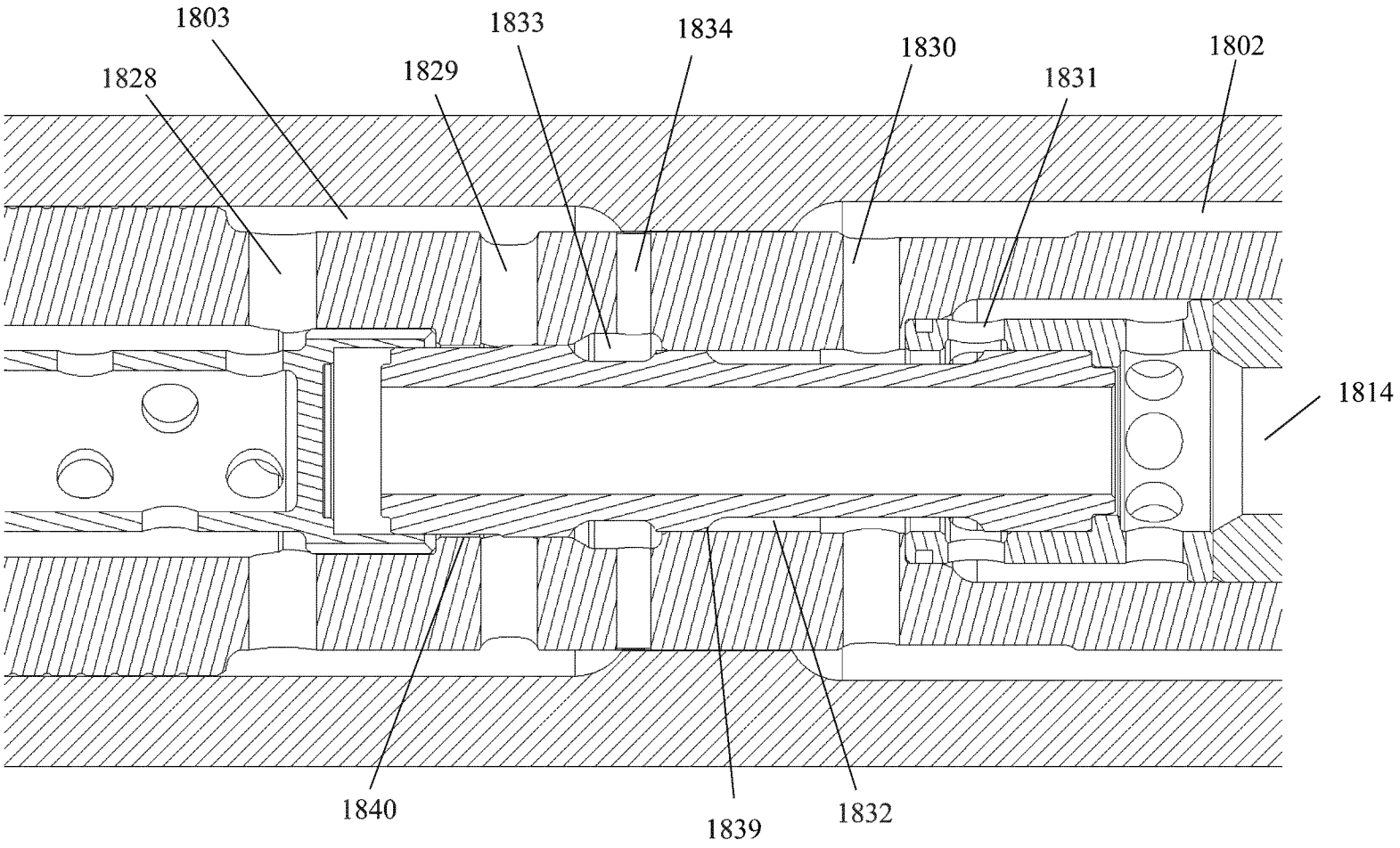
FIG. 18*b* is a detail view of a portion of the hammer of FIG. 18*a;*

A hydraulic down-the-hole hammer 1800 according to another embodiment of the invention is illustrated in FIGS. 18*a* and 18*b*. The hammer shown is a low-cost disposable or single-use hammer. However, various aspects of this embodiment may also be applied to multiple-use hammers. As in the embodiments described above, the hammer comprises an elongate shaft 1812 formed with a central bore 1814. A piston 1801 also has a central bore 1810 therethrough. The shaft is received within the piston bore such that the piston is slidably mounted for reciprocal movement on the shaft 1812 and arranged to impact an annular shoulder 1815 at a rear end 1816 of a percussion bit 1809. Forward 1802 and rear 1803 drive chambers for the piston are disposed between the piston 1801 and the shaft 1812. An annular shoulder 1813 on the piston formed internally of the piston bore 1810 separates the forward chamber 1802 from the rear chamber 1803. In this embodiment, an internal diameter of the piston 1801 to the rear of the shoulder 1813 is smaller than the internal diameter of the piston forward of the shoulder, such that the forward chamber has a larger driving area than the rear chamber. The hammer also comprises a control valve 1805 arranged within the central bore 1814 of the shaft to control reciprocation of the piston.

The control valve 1805 is illustrated in more detail in FIG. 18*b*. The valve 1805 comprises a top or rear inlet port 1828 and a top or rear outlet port 1829. The valve further comprises a bottom or forward inlet port 1830 and a bottom or forward outlet port 1831. Also shown in FIG. 18*b* are the valve undercut 1832, the pilot chamber 1833, the pilot port 1834, the valve shoulder 1839 and the valve high pressure chamber 1840.

Figure 19A:
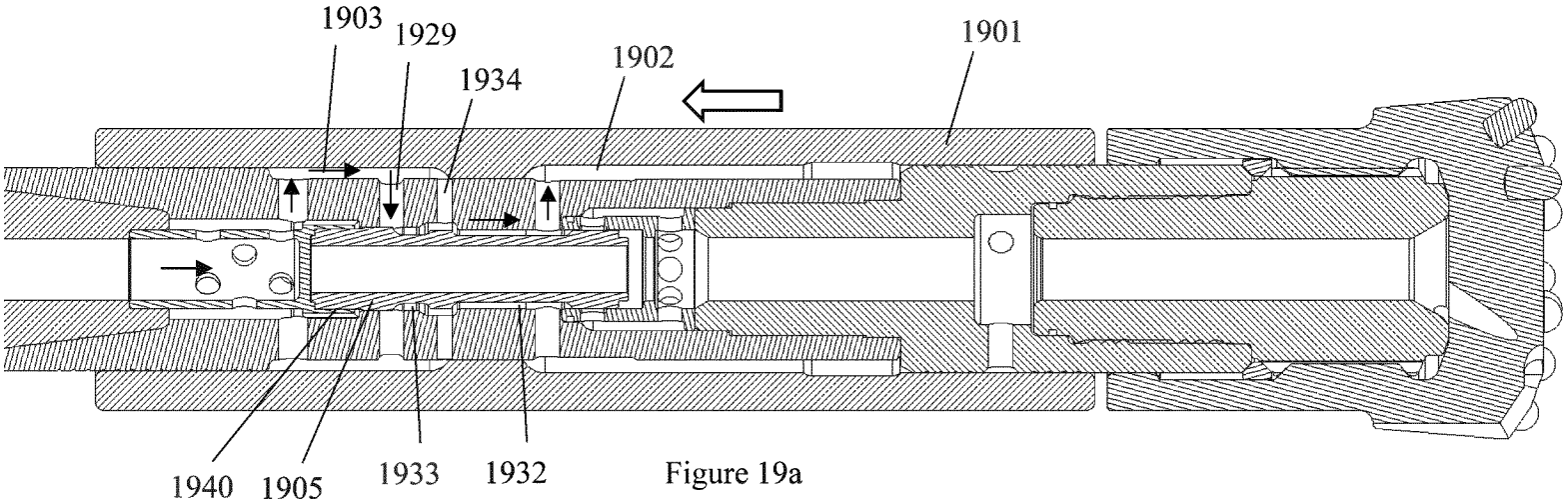
FIGS. 19*a* to 19*d* depict different stages of the hammer cycle of the hammer of FIGS. 18*a* and 18*b;*

An example of the hammer cycle for a disposable hammer including the valve of FIGS. 18*a* and 18*b* is illustrated in FIGS. 19*a* to 19*d*. In FIG. 19*a*, the piston 1901 is moving in an upward or rearward direction (to the left as shown in the drawings). The rear chamber 1903 is connected to pressure fluid throughout the hammer cycle. The forward chamber 1902 is connected to high pressure fluid through the rear outlet port 1929, the pilot chamber 1933, the valve undercut 1932 and the forward inlet port 1930, as shown by the arrows. The forward chamber has a bigger pressure area than the rear chamber, due to the increased internal diameter of the piston 1901 so that the piston moves in a rearward direction. The valve pilot chamber 1933 is pressurised through the pilot port 1934 and/or the rear outlet port 1929. The pilot chamber 1933 has a bigger pressure area than the valve high pressure chamber 1940, which is continuously connected to high pressure fluid. The flow connection between the forward chamber 1902 and the shaft bore 1914 is closed.

Figure 19B:
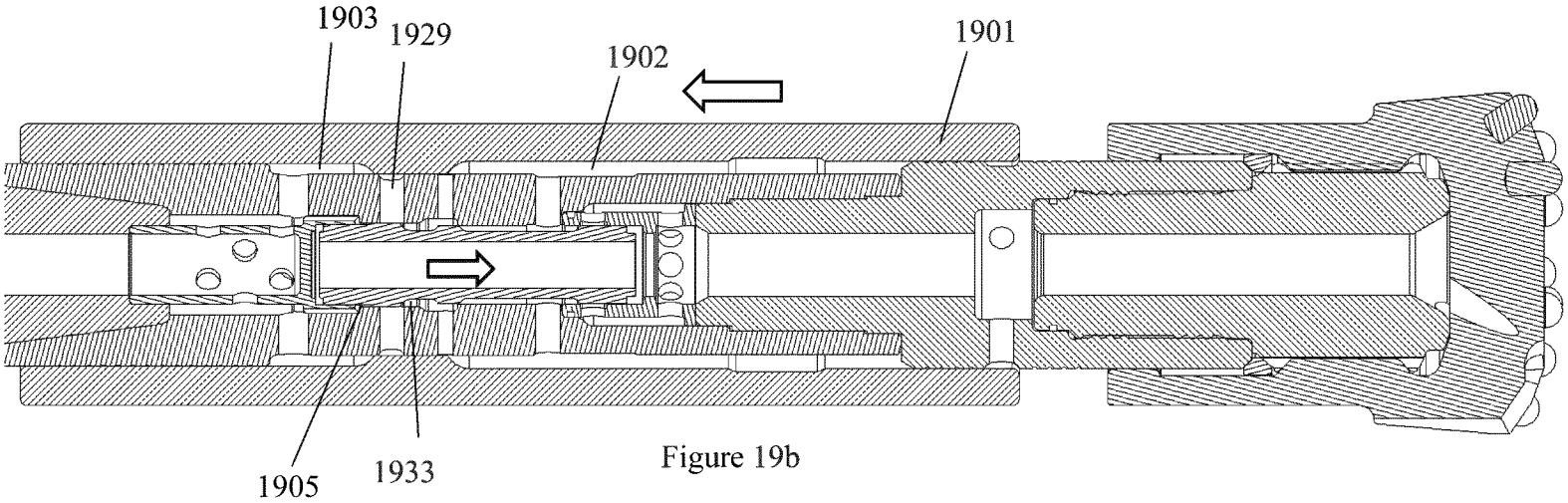

In FIG. 19*b*, the piston 1901 has reached a point where the piston disconnects the rear outlet port 1929 from the rear chamber 1903. The forward chamber 1902 does not receive pressure fluid from the rear chamber and the piston will continue to move upwards due to its inertia. The pressure in the forward chamber and in the pilot chamber 1933 will collapse and there will be a net hydraulic force causing the valve 1905 to switch.

Figure 19C:
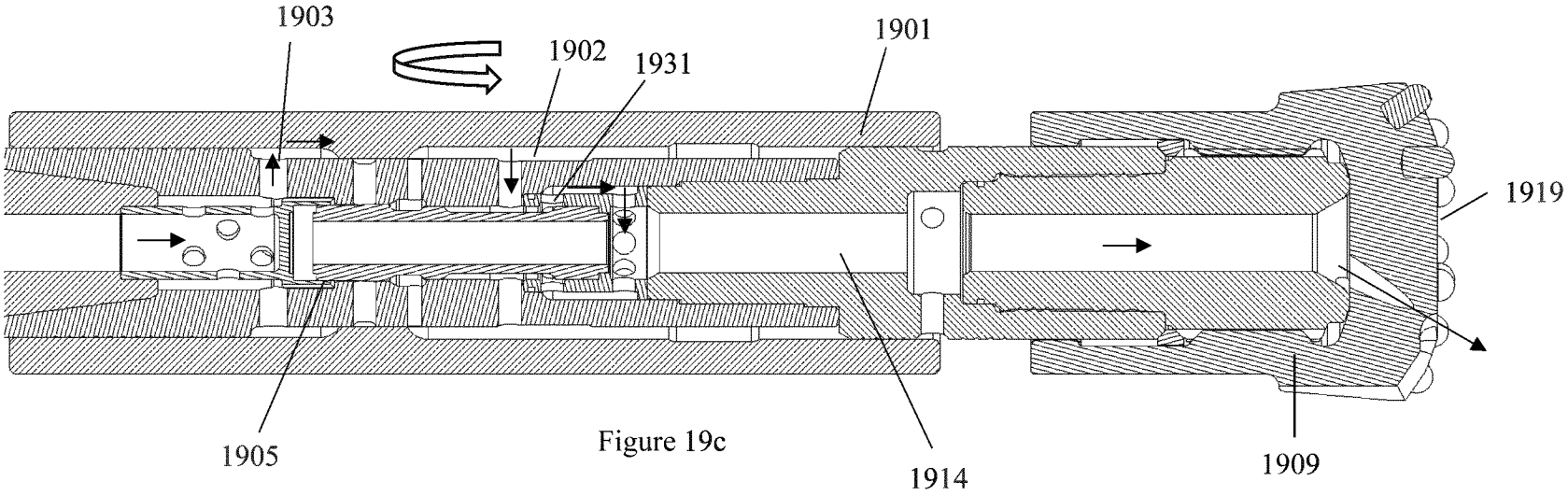

In FIG. 19*c*, the valve 1905 has switched. The valve has closed the flow connection between the rear chamber 1903 and the forward chamber 1902 and opened the forward outlet port 1931 so that exhaust water flows into the shaft bore 1914, as shown by the arrow. The hydraulic force reverses the direction of the piston 1901 and drives it towards the drill bit 1909. The exhaust water will flow through the shaft bore and the bit to exit at the bit face 1919, as shown by the arrows, to flush cuttings from the bit face. Although not shown, radial flushing ports may also extend from the central bore of the shaft to an outer surface of the shaft, allowing part of the exhaust fluid to exit between a forward end of the piston and the strike face of the bit, as described above.

Figure 19D:
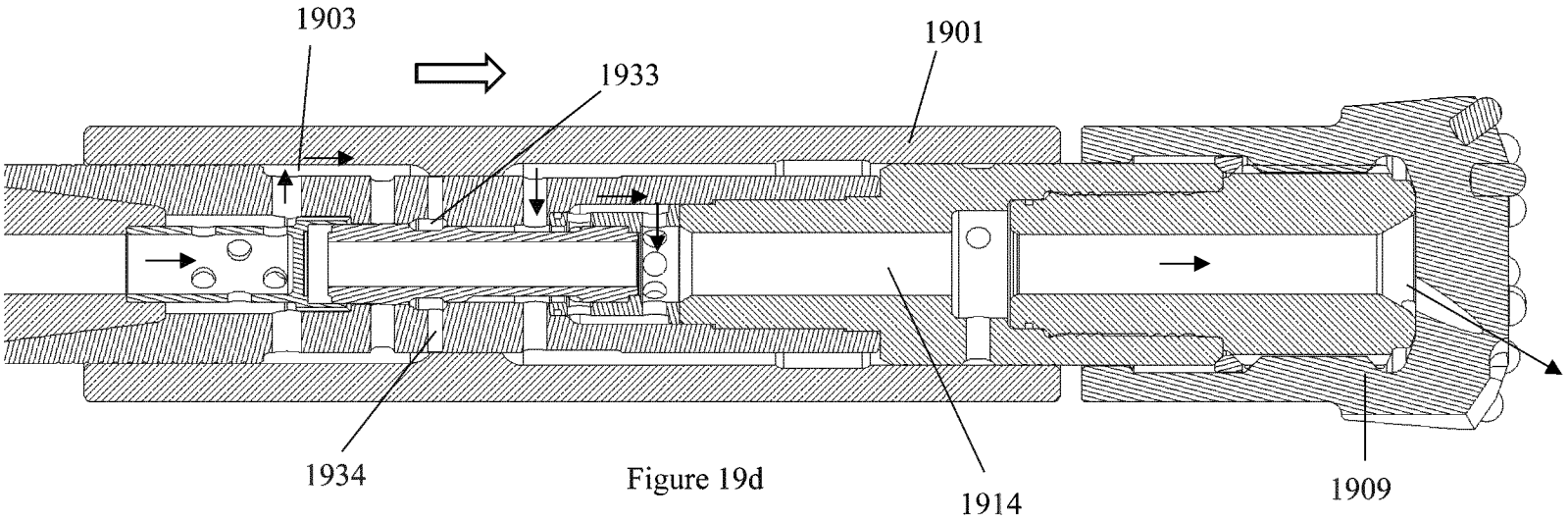

In FIG. 19*d*, the piston 1901 is travelling towards the bit 1909 (to the right as shown in the drawings). Just before the impact, the piston 1901 will connect the pilot chamber 1933 to the rear chamber 1903 via the pilot port 1934. This causes the valve to switch just after the piston has impacted the drill bit. The cycle begins again as shown in FIG. 19*a*.

Figure 20A:
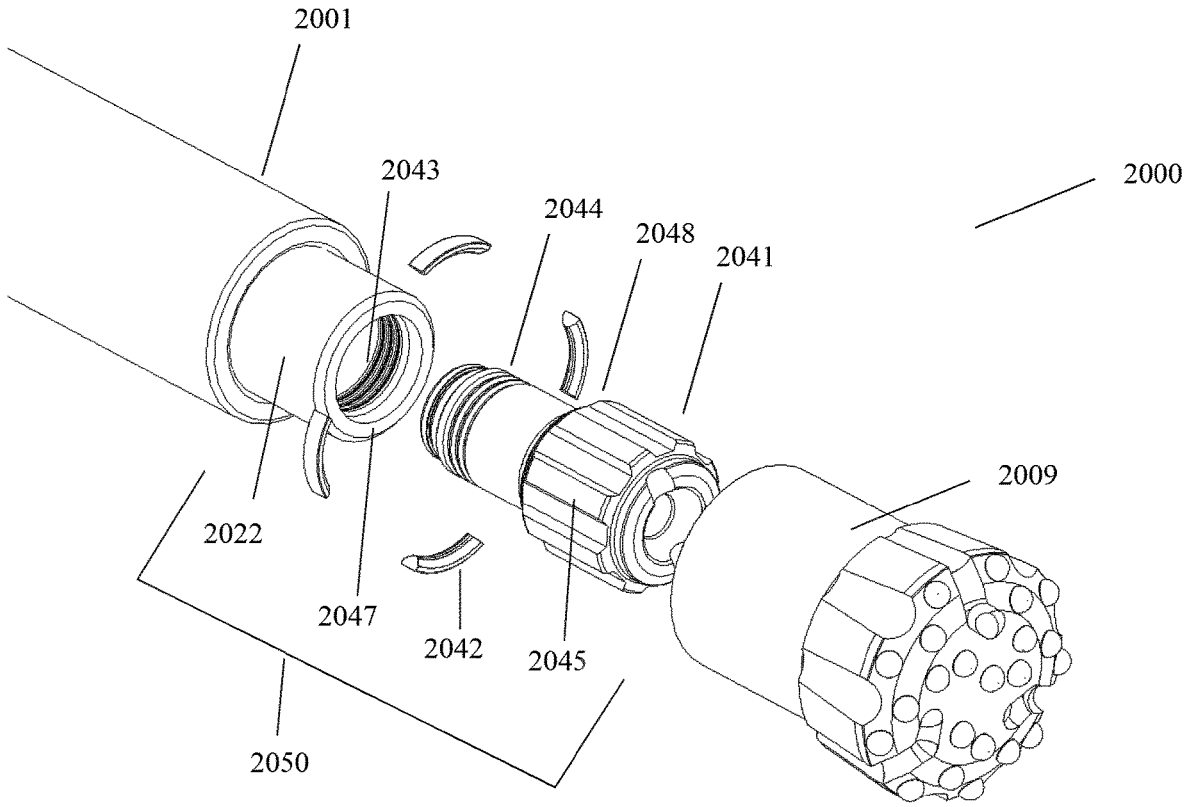
FIG. 20*a* is a perspective view of a coupling element, chuck and a bit of a hammer according to the present invention.
Figure 20B:
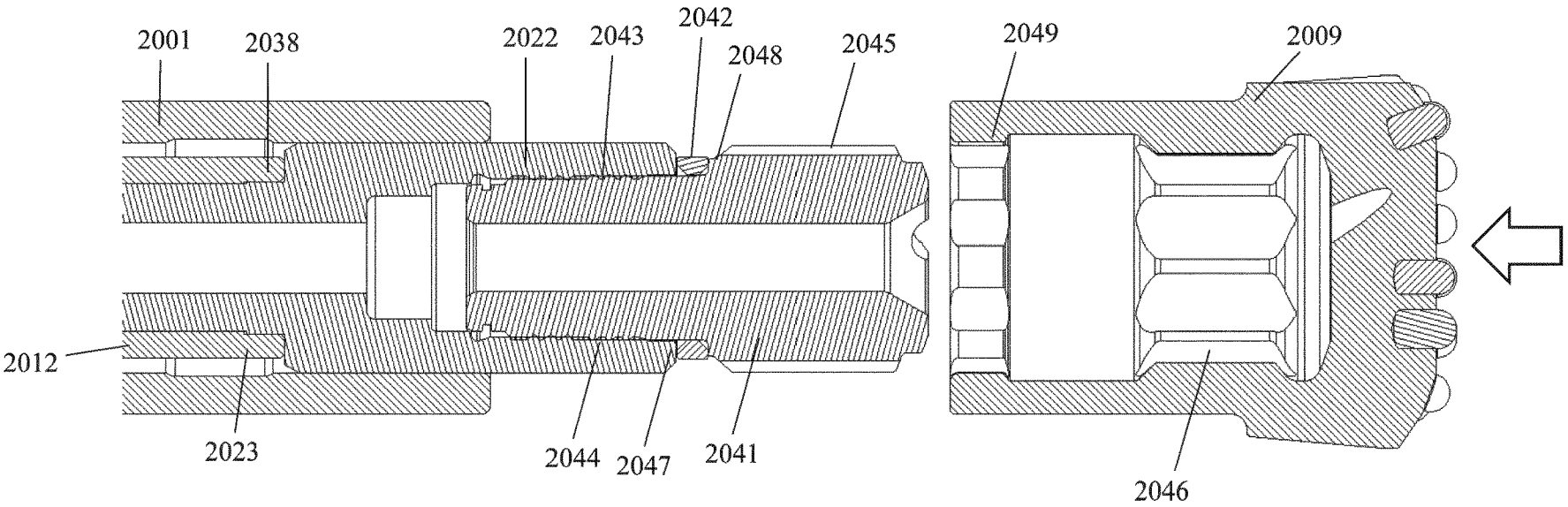
FIG. 20*b* is a cross-sectional view of the coupling element, chuck and bit of FIG. 20*a*, in which the chuck is assembled to the coupling element of the hammer.
Figure 20C:
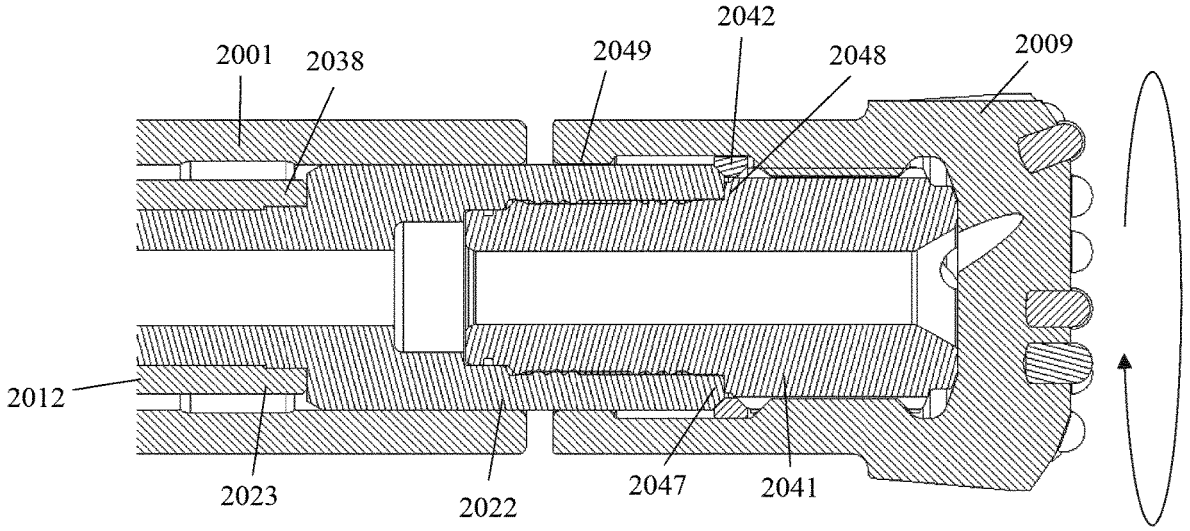
FIG. 20*c* is a cross-sectional view of the assembly of FIG. 20*b*, in which the bit is coupled to the chuck.

FIGS. 20*a*, 20*b* and 20*c* illustrate a coupling arrangement for coupling a percussion bit to a hammer according to the present invention. Hammer 2000 shown in FIGS. 20*a*, 20*b* and 20*c* is similar in several respects to disposable hammer 1800 shown in FIGS. 18*a* and 18*b* but the coupling arrangement shown may also be applied to other hammers in accordance with the invention.

The shaft 2012 of hammer 2000 comprises a coupling assembly 2050 at forward end 2023 thereof. The coupling assembly comprises a seal flange 2022 and a coupling element in the form of a chuck 2041. As shown in FIGS. 20*b* and 20*c*, an outer diameter of the seal flange is greater than an outer diameter of a main body 2038 of the shaft, so that the forward chamber is sealed by the seal flange and the piston 2001. The seal flange 2022 is formed with connection means comprising an internal screw thread 2043 at forward end thereof. Complementary connection means comprising an external screw thread 2044 are provided on a rear portion of the chuck. Engagement means, in the form of axially extending splines 2045 provided externally of the chuck, are engageable with complementary engagement means, in the form of corresponding splines 2046 provided internally of the bit 2009, whereby rotational drive from the shaft may be transmitted to the bit. In other embodiments, the chuck may be formed with a square, hexagonal or octagonal cross-section and the internal portion of the bit may be correspondingly shaped, as described above.

The hammer 2000 further comprises bit retaining means on the chuck engageable with complementary retaining means on the bit 2009 for longitudinal coupling of the bit to the hammer. In the embodiment shown in FIGS. 20*a*, 20*b* and 20*c*, the bit retaining means comprises a bit retaining ring 2042, comprising a plurality of part-annular sectors, and the complementary bit retaining means comprises a shoulder 2049 formed internally of the bit at a rear end thereof.

Figure 9:
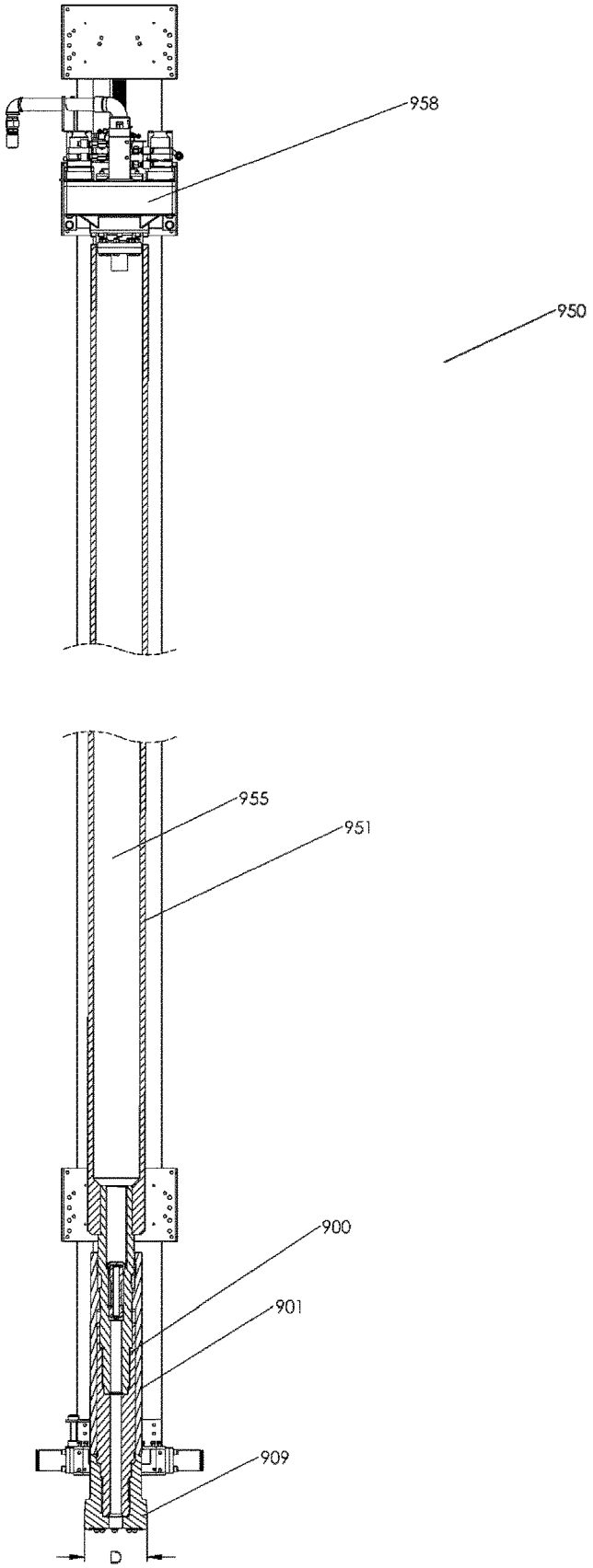
FIG. 9 is a cross-sectional view of an assembly comprising a disposable water hammer connected to a drill rig and drill pipe, suitable for use in a system for installing a subsea pile.

The bit is coupled to the hammer by screwing the screw thread 2044 on the chuck into the screw thread 2043 on the seal flange 2022. The seal flange is also connected to the main body 2038 of the shaft 2012 by way of a screw-threaded connection. Sufficient space is left between a forward end 2047 of the seal flange and an annular shoulder 2048 on the chuck to allow the sectors of the bit retaining ring 2042 to be inserted therebetween. The drill bit is then pushed over the chuck so that the splines 2045 on the chuck engage with the complementary splines 2046 on the drill bit. The screw-threaded connection between the chuck and the seal flange is then tightened by rotating the drill bit 2009. As the connection tightens, the annular shoulder 2048 on the chuck is pushed towards the forward end 2047 of the seal flange, thereby forcing the sectors of the bit retaining ring 2042 outwards, as shown in FIG. 20*c*. The drill bit is retained in the hammer by engagement between the shoulder 2049 and the bit retaining ring 2042. An assembly 950 for use in a system for installing a load-bearing element such as a subsea pile in a seabed is illustrated in FIG. 9. The assembly comprises a disposable or sacrificial hydraulic down-the-hole hammer 900. The hammer 900 is a water hammer similar to the hammer 700 shown in FIGS. 7*a* and 7*b* and comprises a piston 901, arranged to strike a bit 909. The piston 901 is the outermost component of the hammer and the percussion bit 909 has a diameter D larger than that of the piston. The assembly further comprises a drill pipe 951 connected between a drill rig 958 and the hammer, the drill pipe having a central bore 955 therethrough.

The drill rig 958 is configured to provide rotation and feed force to the hammer during drilling of the hole. The drill rig is connected to the drill pipe 951 and hammer 900 and lowered to the seabed 954 with the hammer prior to drilling.

Figure 10:
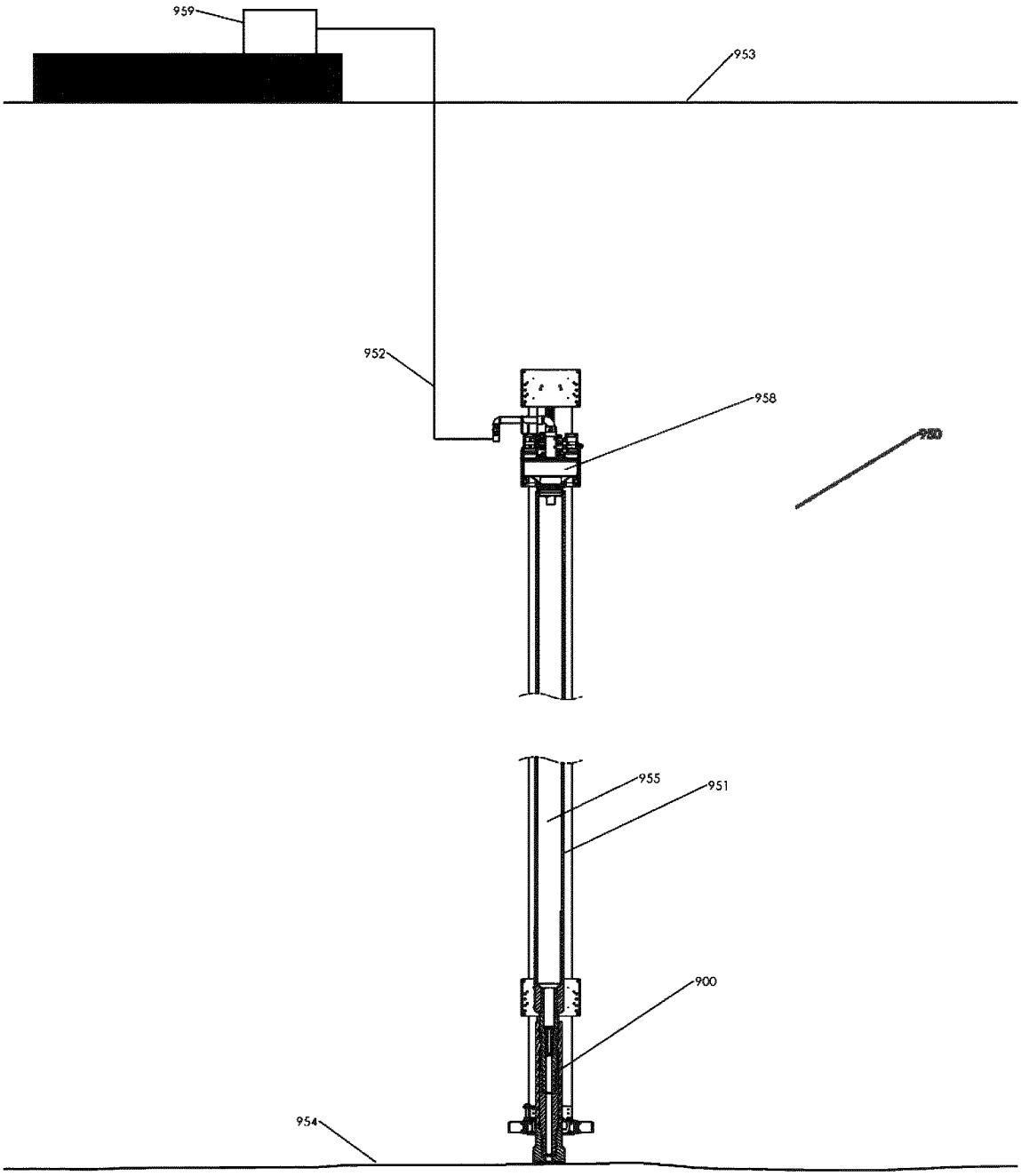
FIG. 10 is a cross-sectional view of a system for installing a subsea pile including the assembly of FIG. 9, during drilling of a hole in the seabed.

As shown in FIG. 10, the system also comprises an umbilical 952, wherein the hammer is connectable, via the drill pipe, to a supply of pressurised water and a supply of grout through the umbilical. The supply of water and the supply of grout are provided a sea surface level 953. A water pump and a grout pump on a vessel 959 provide the supply of water and the supply of grout, respectively.

Figure 11:
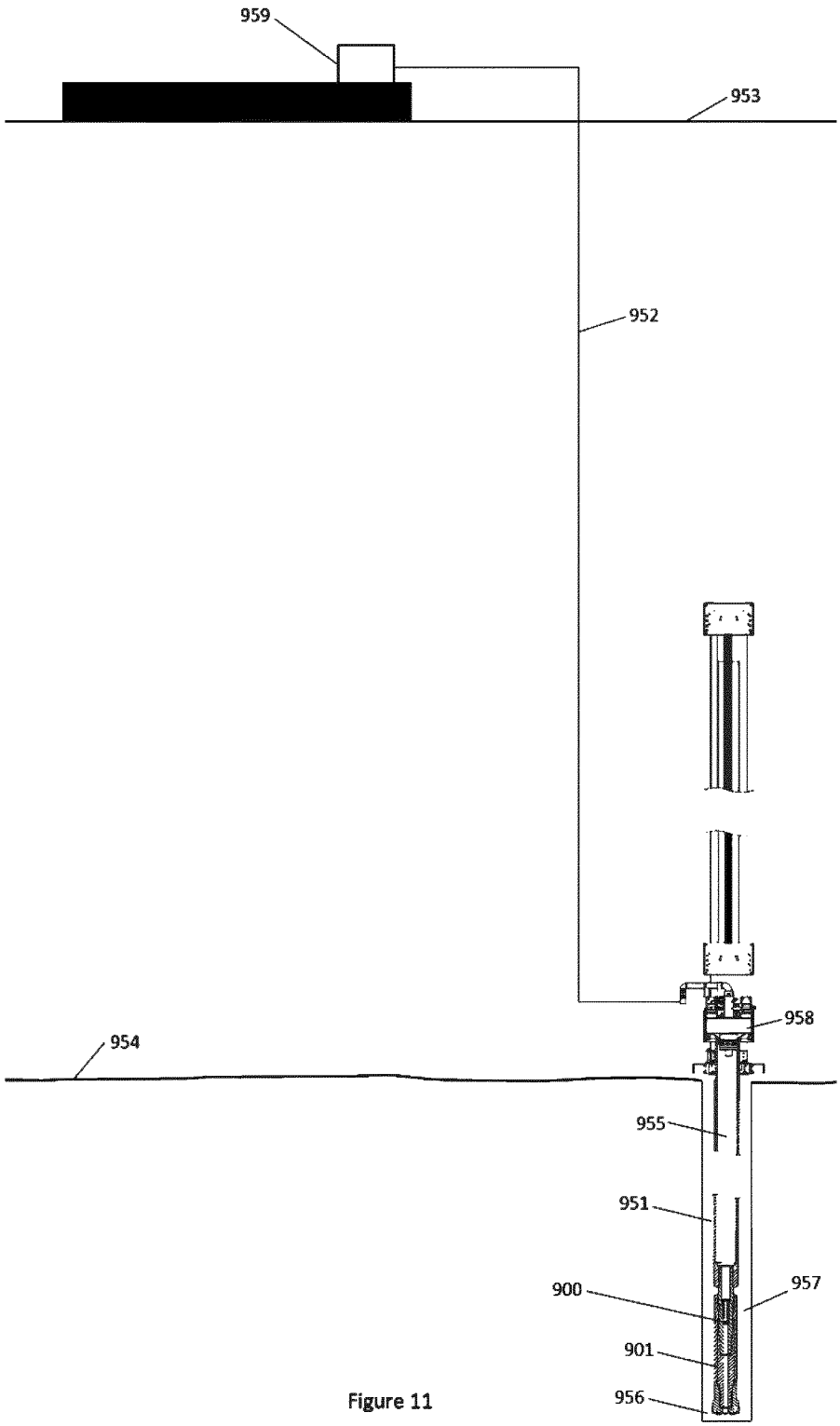
FIG. 11 is a cross-sectional view of the system of FIG. 10, after drilling of the hole in the seabed.

In use, the drill rig is coupled to the hammer via the drill pipe 951, and the assembly is lowered to the seabed 954. The hammer 900 is operated by supplying water thereto via the umbilical 952, to drill a hole 956 in the seabed as shown in FIGS. 10 and 11. Rotation and feed force are provided by the drill rig. The operation of the hammer is as described above with reference to FIG. 8. When the hole has reached the desired depth, as shown in FIG. 11, the rotation and feed force are stopped and the supply of water to the hammer is stopped, for example, by disconnecting the umbilical from the water pump. As shown in FIG. 11, a diameter of the drilled hole 956 is greater than a diameter of the piston 901 so that there exists an annular cavity 957 between the piston and a wall of the drilled hole.

Figure 12:
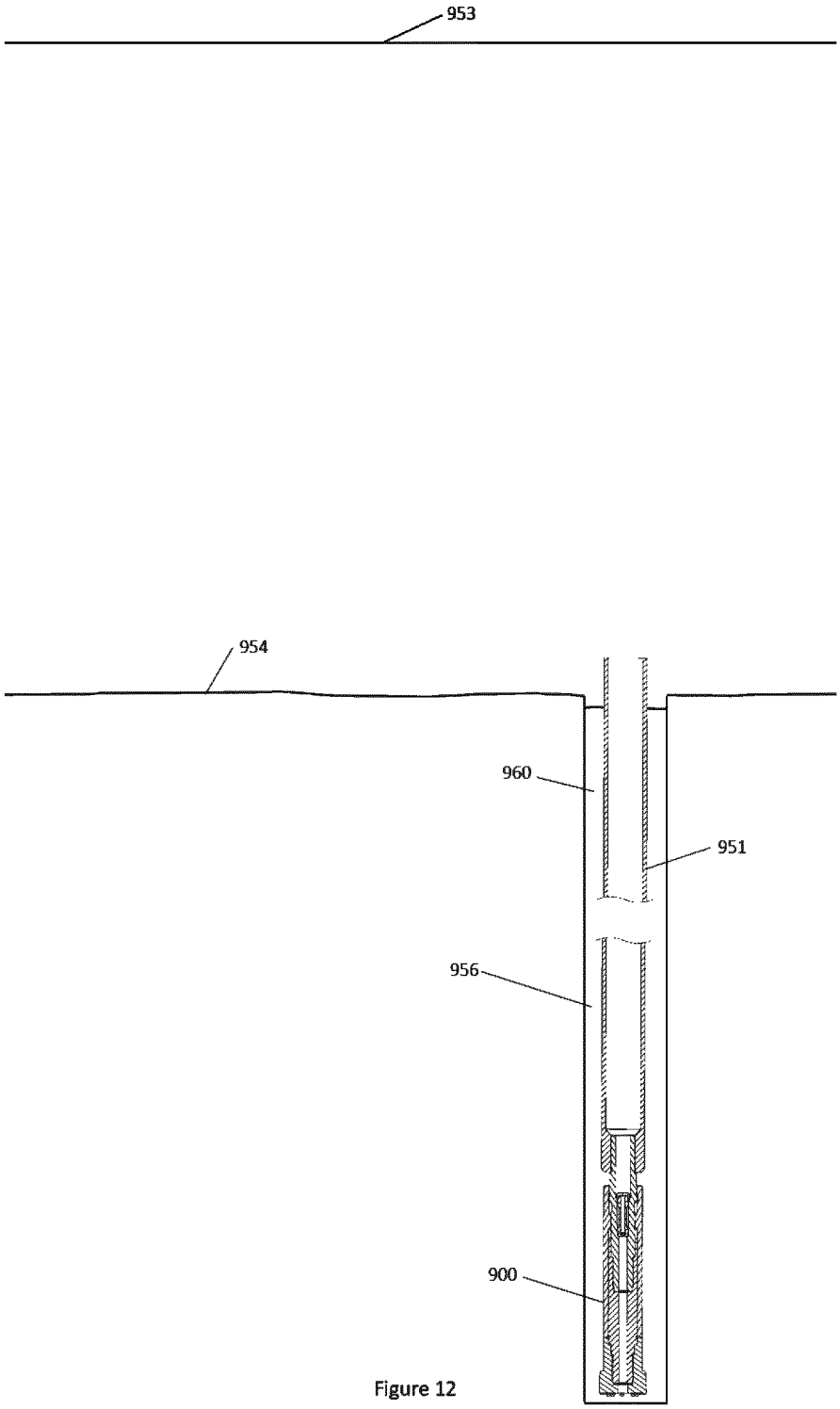
FIG. 12 is a cross-sectional view of a subsea pile, comprising the hammer and drill pipe of FIG. 9.

Grout 960 is then supplied to the hammer via the umbilical, for example, by connecting the umbilical to the grout pump. The grout flows through the central bore 955 of the drill pipe and the hammer 900 and into the hole 956 through the bit 909. Grout is pumped into the hole until the hole has been at least partially filled, as shown in FIG. 12. The drill rig is disconnected from the hammer and returned to the surface. When the grout has cured, the hammer, drill pipe and drill pipe are bonded to the material of the seabed so that the hammer, drill pipe and grout form a subsea pile as shown in FIG. 12.

Figure 13:
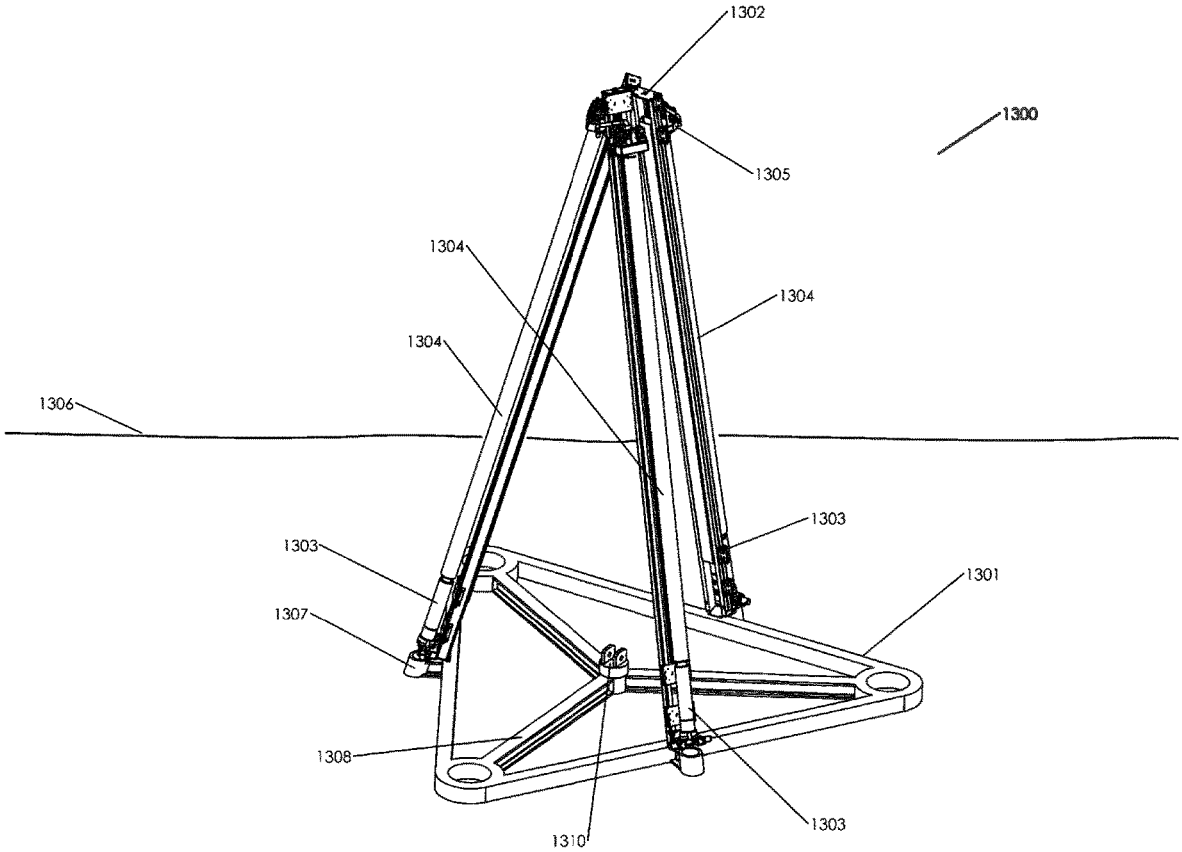
FIG. 13 is a perspective view of an assembly for use in a system for installing a subsea anchor on a seabed according to an aspect of the invention.
Figure 14:
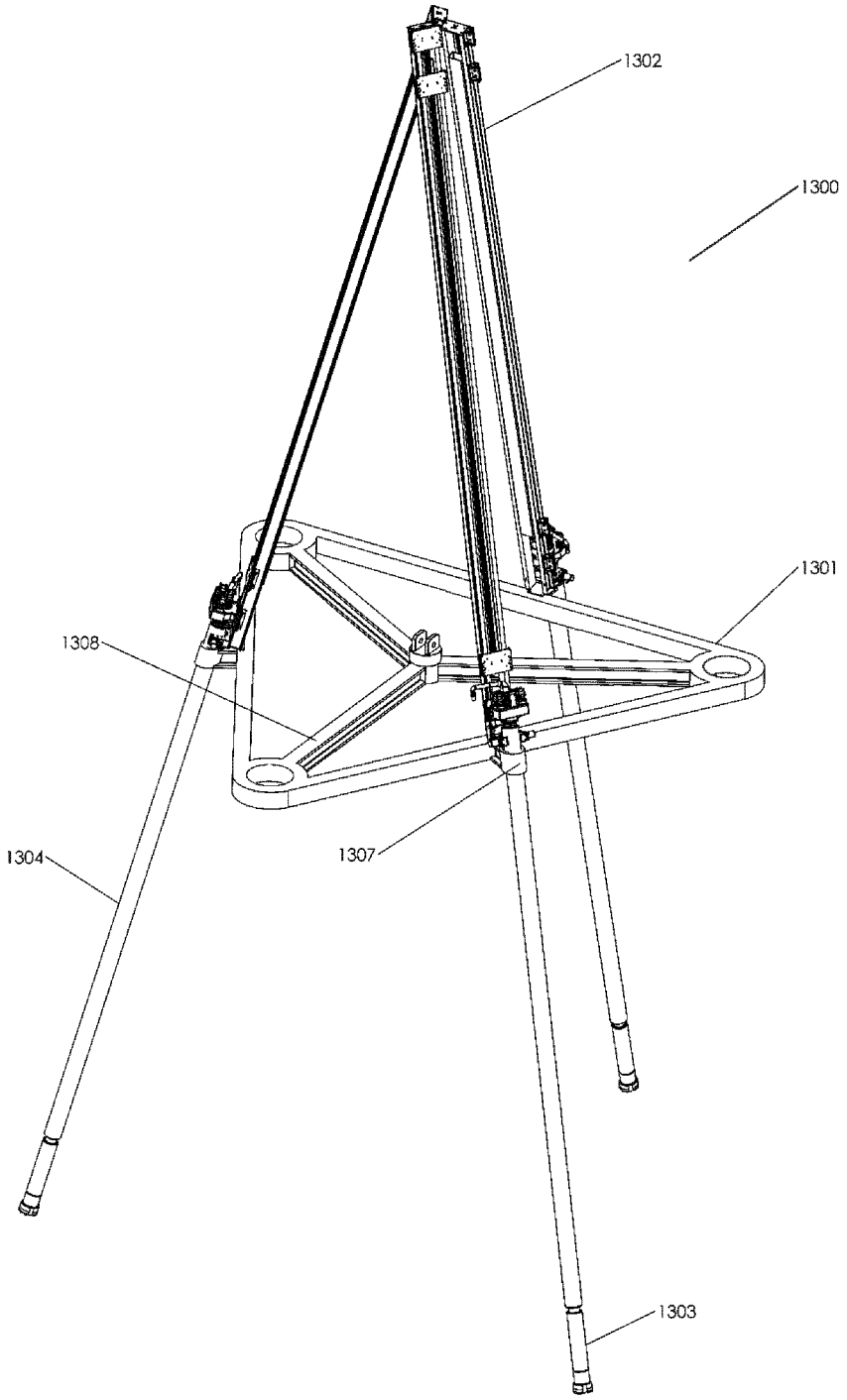
FIG. 14 is a perspective view of the assembly of FIG. 13, after deployment of the hammers.
Figure 15:
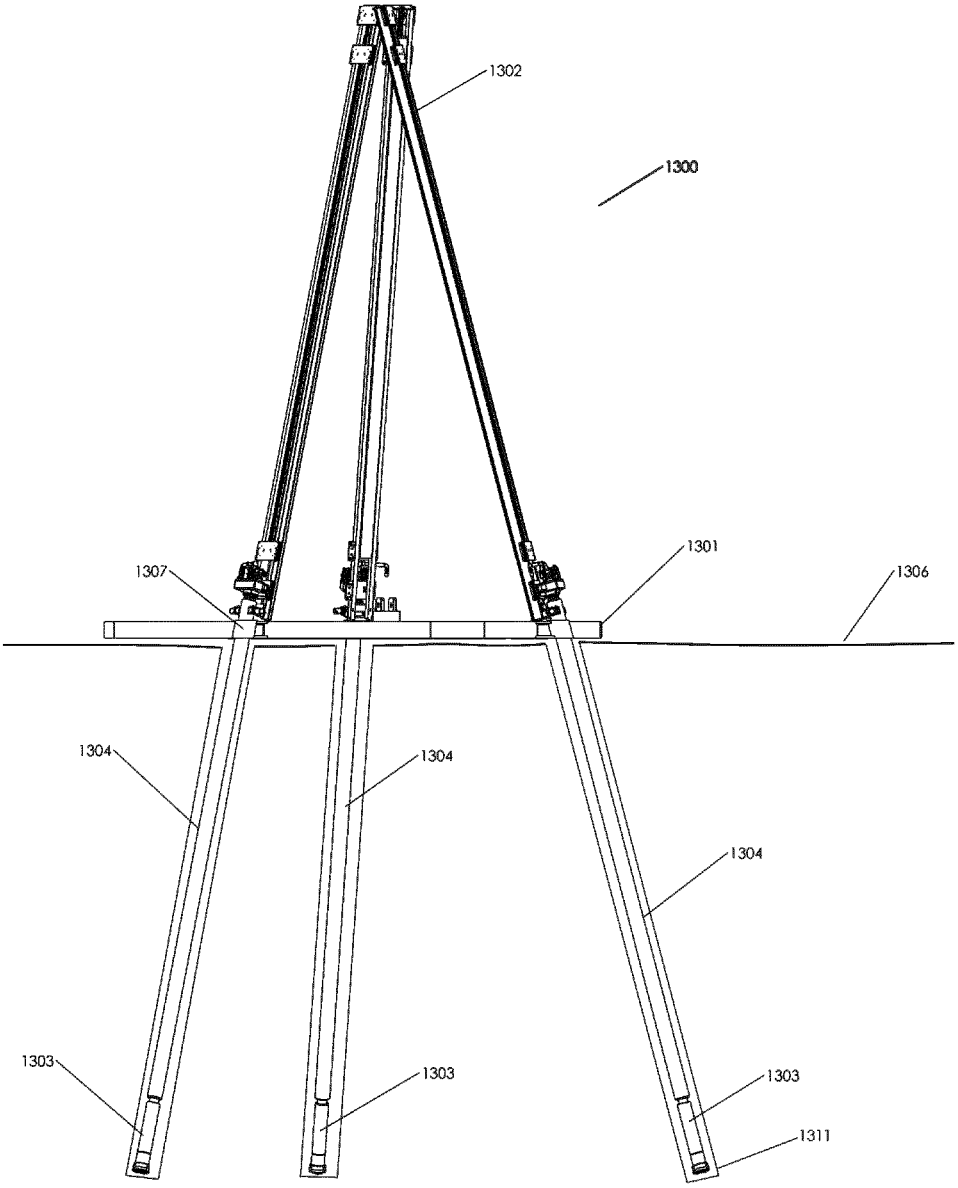
FIG. 15 is a side elevation view of the assembly as shown in FIG. 14.

An assembly 1300 for use in a system for installing a subsea anchor on a seabed is illustrated in FIG. 13 to 15. The assembly comprises an anchor frame or template 1301. In the embodiment shown, the anchor frame is generally triangular in shape, with a plurality of ribs 1308 to enhance its structural integrity. In other embodiments, the anchor may be rectangular, or any other suitable shape. A mooring connection 1310 is also provided on the anchor frame, to allow a mooring line to be connected thereto, for mooring of an offshore structure, such as a wind turbine.

The assembly further comprises drill rig 1302 and three sacrificial down-the-hole hydraulic hammers 1303 and corresponding drill rods or pipes 1304, each of which is connected to the anchor frame 1301 through a connector 1307, in the form of a mounting sleeve or boss, provided on an outer edge of the frame 1301. Each hammer 1303 is a water hammer similar to the hammer 700 shown in FIGS. 7*a* and 7*b*. The drill rig 1302 comprises three identical feed force and rotation systems 1305, so that the drill rig is configured to provide a rotation and feed force to each of the hammer 1303. In other embodiments, the system may comprise more or fewer hammers and the drill rig may comprise a corresponding number of feed force and rotation systems. As shown in FIG. 13, the drill rig 1302 is configured such that each of the hammer and drill pipe pairs is arranged at an acute angle to the seabed 1306.

Each hammer 1303 and corresponding drill pipe 1304 is connectable to a supply of working fluid for drilling a hole 1311 of a desired depth in the seabed 1306, as shown in FIG. 15. In the embodiment shown, the holes are drilled at an angle to the vertical to minimise bending or shear forces on the anchor. However, in other embodiments, the holes may be drilled vertically downwards into the seabed, or at an angle between 20 and 90 degrees to the seabed. The working fluid may be supplied from a rig or vessel at sea surface level as shown in FIG. 10. Because the drill rig 1302 comprises three separate feed force and rotations systems 1305, the holes 1311 may be drilled simultaneously. Alternatively, the holes may be drilled in turn. As the hammers 1303 are operated, each hammer 1303 and drill pipe 1304 passes through the corresponding connector 1307. As shown in FIGS. 14 and 15, when the holes have been drilled, an upper portion of each drill pipe 1304 is retained within the corresponding connector 1307, to connect the anchor to the drill pipes. Once the holes have been drilled, each hammer is connected to a supply of grout while located in its respective hole to allow the hammer and the hole to be at least partially filled with grout. The grout may be supplied via the umbilical as shown in FIG. 10.

Figure 16:
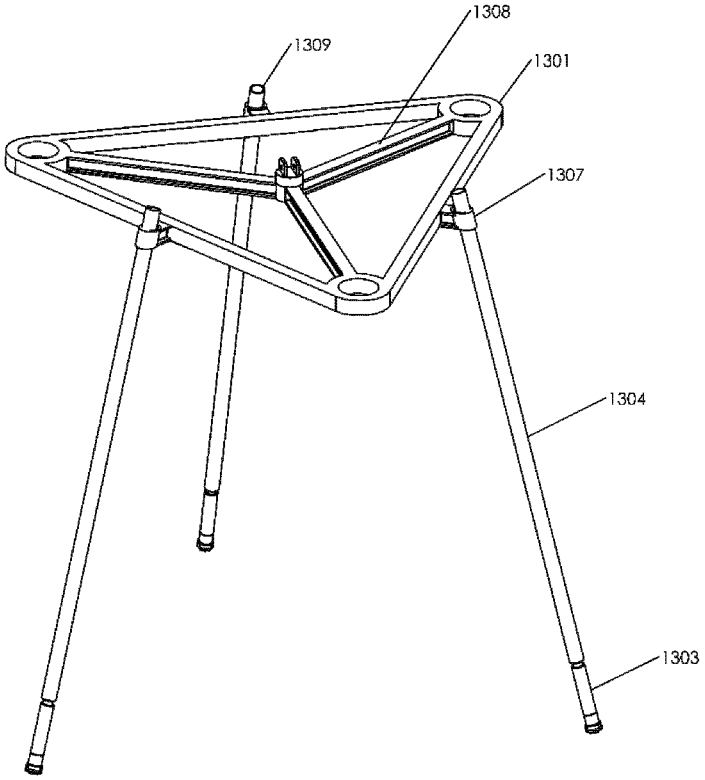
FIG. 16 is a perspective view of the subsea anchor installed on the seabed.
Figure 17:
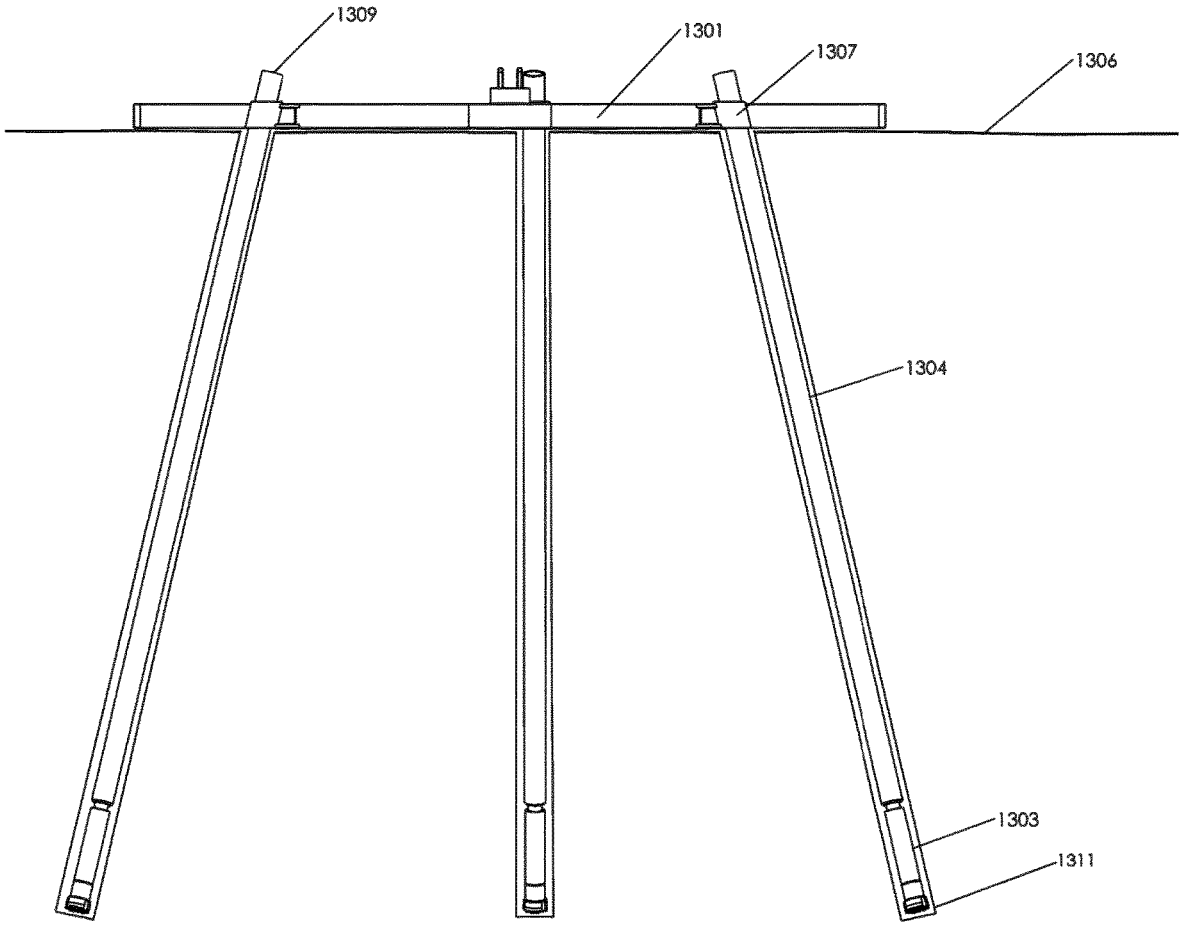
FIG. 17 is a side elevation view of the subsea anchor of FIG. 16.

Once the holes 1311 have been filled with grout, the drill rig 1302 is disconnected from the hammer 1303 and returned to the surface, leaving the subsea anchor on the seabed as shown in FIGS. 16 and 17. Once the grout has cured, the subsea anchor including the anchor frame 1301 is secured to the seabed by the hammers 1303 and corresponding drill pipes 1304 connected to the anchor frame via the connectors 1307. A nut or other fastener may be connected to the upper end 1309 of each of the drill pipes to fasten the anchor frame to the subsea piles formed by the hammer and drill pipe pairs. Each of the hammer and drill pipe pairs is grouted in place in a respective hole in the seabed such that each hammer and drill pipe is bonded to the material of the seabed 1306, thereby securing the anchor in place.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A method for installing a load-bearing element in a seabed, comprising:

drilling a hole of a desired depth in the seabed using a hydraulic down-the-hole hammer, wherein the hammer is operated by supplying working fluid to the hammer;

while the hammer is located in the hole, ceasing supply of working fluid to the hammer;

supplying grout to the hammer to at least partially fill the hammer and the hole in which the hammer is located with grout; and allowing the grout to cure such that the hammer and the grout form a load-bearing element in the seabed.

2. The method as claimed in claim 1, further comprising:

prior to drilling the hole, connecting a drill rig to the hammer and lowering the hammer and drill rig to the seabed; and operating the drill rig to provide rotation and feed force to the hammer during drilling of the hole.

3. The method as claimed in claim 2, further comprising:

after the hole has been at least partially filled with grout, disconnecting the drill rig from the hammer.

4. A system for installing a load-bearing element in a seabed, comprising:

a hydraulic down-the-hole hammer;

a supply of working fluid, wherein the hammer is connectable to the supply of working fluid for drilling a hole of a desired depth in the seabed;

a supply of grout, wherein the hammer is connectable to the supply of grout while located in the hole to allow the hammer and the hole to be at least partially filled with grout the hammer being sacrificially grouted in the hole.

5. The system as claimed in claim 4, wherein the supply of working fluid and the supply of grout are provided at a sea surface level above the seabed, the system further comprising:

an umbilical, wherein the hammer is connectable to the supply of working fluid and the supply of grout through the umbilical.

6. The system as claimed in claim 4, wherein the working fluid is water.

7. The system as claimed in claim 4, comprising:

a working fluid pump configured to provide the supply of working fluid to the hammer; and a grout pump configured to provide the supply of grout to the hammer.

8. The system as claimed in claim 4, further comprising:

a drill rig configured to provide rotation and feed force to the hammer during drilling of the hole, wherein the drill rig is connected to the hammer and lowered to the seabed with the hammer prior to drilling the hole.

9. The system as claimed in claim 4, wherein the hammer comprises:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore; and a control valve to control reciprocation of the piston, wherein the control valve is arranged within the central bore of the piston.

10. The system as claimed in claim 9, wherein the piston is an outermost component of the hammer and wherein the percussion bit has a larger diameter than the piston, such that a diameter of the drilled hole is greater than a diameter of the piston and there exists an annular cavity between the piston and a wall of the drilled hole.

11. A subsea pile, comprising:

a hydraulic down-the-hole hammer, located in a hole in the seabed; and cured grout arranged within the hammer and between the hammer and a wall of the hole such that the hammer is bonded to the material of the seabed by the grout.

12. A method for installing a subsea anchor on a seabed, comprising:

connecting a drill rig and one or more down-the-hole hydraulic hammers to an anchor frame, wherein the drill rig is configured to provide a rotation and feed force to each of the one or more hammers;

lowering the anchor frame to the seabed;

supplying working fluid to the or each hammer, such that the or each hammer drills a hole of a desired depth in the seabed;

while the or each hammer is located in its respective hole, ceasing supply of working fluid to the or each hammer and supplying grout to the or each hammer to at least partially fill the hammer and the hole in which the hammer is located with grout;

allowing the grout to cure such that the or each hammer is bonded to the material of the seabed by grout; and disconnecting the drill rig from the anchor frame.

13. The method as claimed in claim 12, wherein the drill rig provides a separate rotation and feed force to the or each hammer.

14. The method as claimed in claim 12, comprising a plurality of hammers and wherein each hammer drills its respective hole in the seabed simultaneously.

15. The method as claimed in claim 12, further comprising coupling a mooring line to the anchor frame.

16. A system for installing a subsea anchor on a seabed, comprising:

an anchor frame;

a drill rig and one or more down-the-hole hydraulic hammers connectable to the anchor frame, wherein the drill rig is configured to provide a rotation and feed force to each of the one or more hammers;

a supply of working fluid, wherein the or each hammer is connectable to the supply of working fluid for drilling a hole of a desired depth in the seabed;

a supply of grout, wherein the or each hammer is connectable to the supply of grout while located in its respective hole to allow the hammer and the hole to be at least partially filled with grout, the or each hammer being sacrificially grouted in the hole.

17. The system as claimed in claim 16, wherein the drill rig comprises a separate feed and rotation system for each of the one or more hammers.

18. The system as claimed in claim 16, wherein the supply of working fluid and the supply of grout are provided at a sea surface level above the seabed, the system further comprising:

an umbilical, wherein the or each hammer is connectable to the supply of working fluid and the supply of grout through the umbilical.

19. The system as claimed in claim 16, wherein the or each hammer comprises:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore; and a control valve to control reciprocation of the piston, wherein the control valve is arranged within the central bore of the piston.

20. The system as claimed in claim 19, wherein the piston is an outermost component of the or each hammer and wherein the percussion bit of the or each hammer has a larger diameter than the piston, such that a diameter of the or each drilled hole is greater than a diameter of the respective piston and there exists an annular cavity between the or each piston and a wall of the respective drilled hole.

21. A subsea anchor, comprising:

an anchor frame, disposed on the seabed; and one or more hydraulic down-the-hole hammers connected to the anchor frame, the or each hammer located in a respective hole in the seabed; and cured grout arranged within the or each hammer and between the hammer and a wall of the respective hole such that the or each hammer is bonded to the material of the seabed by the grout.

* * * * *